US007814604B2

(12) United States Patent
Gavney, Jr.

(10) Patent No.: US 7,814,604 B2
(45) Date of Patent: Oct. 19, 2010

(54) DEVICE WITH MULTI-STRUCTURAL CONTACT ELEMENTS

(76) Inventor: James A. Gavney, Jr., 996 Amarillo, Palo Alto, CA (US) 94303

( * ) Notice: Subject to any disclaimer, the term of this patent is extended or adjusted under 35 U.S.C. 154(b) by 1063 days.

(21) Appl. No.: 11/080,199

(22) Filed: Mar. 14, 2005

(65) Prior Publication Data

US 2005/0155172 A1 Jul. 21, 2005

Related U.S. Application Data

(63) Continuation of application No. 09/957,302, filed on Sep. 19, 2001, now Pat. No. 6,865,767.

(60) Provisional application No. 60/233,580, filed on Sep. 19, 2000.

(51) Int. Cl.
*A47L 13/12* (2006.01)
*A46B 9/04* (2006.01)

(52) U.S. Cl. ..... 15/114; 15/245; 15/160; 15/167.1; 15/110; 601/137

(58) Field of Classification Search ..... 15/167.1, 15/167.2, 110, 188, 121, 114, 245, 201, 106–107, 15/160, 117, 420, 401, 402, 367, 364, 309, 15/97.7, 97.1; 601/137, 138, 139; 433/216, 433/141

See application file for complete search history.

(56) References Cited

U.S. PATENT DOCUMENTS

| | | | | |
|---|---|---|---|---|
| 75,421 | A * | 3/1868 | Hayward | 15/117 |
| 116,030 | A | 6/1871 | Devines | |
| 116,346 | A | 6/1871 | O'Brian | |
| 218,431 | A | 8/1879 | Dunham | |
| 411,910 | A | 10/1889 | Van Horne | |
| 742,639 | A | 10/1903 | Harlan | |
| 907,842 | A | 12/1908 | Meuzies | |
| 915,251 | A | 3/1909 | Vanderslice | |
| 1,006,630 | A | 10/1911 | Clarke | |
| 1,128,139 | A | 2/1915 | Hoffman | |

(Continued)

FOREIGN PATENT DOCUMENTS

| | | |
|---|---|---|
| CH | 172320 | 12/1934 |

(Continued)

OTHER PUBLICATIONS

"A new high-performance manual toothbrush" Supported by the Colgate-Palmolive Company, 2004 Medical World Business Press, Inc.

(Continued)

*Primary Examiner*—Gary K Graham
(74) *Attorney, Agent, or Firm*—JAG Patent Services LLC; James A. Gavney, Jr.

(57) ABSTRACT

A contact device with resilient contact elements is disclosed. The resilient contact elements have primary structures and secondary structures. The primary structures and secondary structures have contact surfaces for engaging a working surface. The primary structures are preferably molded structures with hardness value between 10 to 90 Shores A. The secondary structures are nodules, squeegees, arrays of nodules or squeegees and matrices but are preferably bristle structures formed from plastic resins, wherein the device is configured clean dentition.

6 Claims, 14 Drawing Sheets

U.S. PATENT DOCUMENTS

| | | | | | |
|---|---|---|---|---|---|
| 1,142,698 | A | | 6/1915 | Grove et al. | |
| 1,188,823 | A | | 6/1916 | Plank | |
| 1,191,556 | A | | 7/1916 | Blake | |
| 1,268,544 | A | | 6/1918 | Cates | |
| 1,297,272 | A | | 3/1919 | Strang et al. | |
| 1,405,279 | A | | 1/1922 | Cassedy | |
| 214,701 | A | | 4/1924 | Dessau | |
| 1,500,274 | A | | 7/1924 | Scarling | |
| 1,526,267 | A | | 2/1925 | Dessau | |
| 1,578,074 | A | | 3/1926 | Chandler | |
| 1,588,785 | A | | 6/1926 | Van Sant | |
| 1,598,224 | A | | 8/1926 | Van Sant | |
| 290,515 | A | | 5/1928 | Voltz et al. | |
| 305,735 | A | | 2/1929 | Leeson et al. | |
| 1,705,249 | A | | 3/1929 | Henry | |
| 1,707,118 | A | | 3/1929 | Goldberg | |
| 1,720,017 | A | | 7/1929 | Touchstone | |
| 1,766,529 | A | | 6/1930 | Peirson | |
| 1,833,555 | A | | 11/1931 | Bell et al. | |
| 1,852,480 | A | | 4/1932 | Ruetz | |
| 1,868,893 | A | | 7/1932 | Gentle | |
| 1,910,414 | A | | 5/1933 | Varga | |
| 1,924,152 | A | | 8/1933 | Coney et al. | 15/167 |
| 1,965,009 | A | | 7/1934 | Stevens | 15/188 |
| 1,993,662 | A | | 3/1935 | Green | 15/110 |
| 1,993,763 | A | | 3/1935 | Touchstone | 15/180 |
| 2,008,636 | A | | 7/1935 | Brynan | 91/67.4 |
| 2,042,239 | A | | 5/1936 | Planding | 15/110 |
| 2,059,914 | A | | 11/1936 | Rosenberg | 15/110 |
| 2,088,839 | A | | 8/1937 | Coney et al. | 15/188 |
| 2,117,174 | A | | 5/1938 | Jones | 15/110 |
| 2,129,082 | A | | 9/1938 | Byrer | 128/62 |
| 2,139,245 | A | | 12/1938 | Ogden | 128/62 |
| 2,144,408 | A | | 1/1939 | Holmes | 128/62 |
| 2,154,846 | A | | 4/1939 | Heymann et al. | 128/62 |
| 2,164,219 | A | | 6/1939 | McGerry | 128/62 |
| 2,179,454 | A | * | 11/1939 | Paulus | 15/250.4 |
| 2,207,582 | A | * | 7/1940 | Dunbar | 15/367 |
| 2,219,753 | A | | 10/1940 | Seguin | 15/188 |
| 2,226,145 | A | | 12/1940 | Smith | 15/29 |
| 2,244,699 | A | | 6/1941 | Hosey | 15/188 |
| 2,279,355 | A | | 4/1942 | Wilensky | 15/110 |
| 2,283,428 | A | * | 5/1942 | Ellis | 15/416 |
| 2,312,828 | A | | 3/1943 | Adamsson | 15/167 |
| 2,321,333 | A | | 6/1943 | Terry | 15/135 |
| 2,334,796 | A | | 11/1943 | Steinmetz et al. | 15/121 |
| 2,443,461 | A | | 6/1948 | Kempster | 15/188 |
| 620,151 | A | | 3/1949 | Emsa-Works et al. | |
| 2,516,491 | A | | 7/1950 | Swastek | 15/188 |
| 2,518,765 | A | | 8/1950 | Ecker | 15/115 |
| 2,534,086 | A | | 12/1950 | Vosbikian et al. | 15/245 |
| 2,545,814 | A | | 3/1951 | Kempster | 15/188 |
| 2,637,870 | A | | 5/1953 | Cohen | 15/188 |
| 2,702,914 | A | | 3/1955 | Kittle et al. | 15/114 |
| 2,757,668 | A | | 8/1956 | Meyer-Saladin | 128/173.1 |
| 2,815,601 | A | | 12/1957 | Hough, Jr. | 41/5.5 |
| 2,875,458 | A | | 3/1959 | Tsuda | 15/22 |
| 2,884,151 | A | | 4/1959 | Biederman | 215/41 |
| 2,946,072 | A | | 7/1960 | Filler et al. | 15/110 |
| 2,987,742 | A | | 6/1961 | Kittle et al. | 15/114 |
| 34,109 | A | | 1/1962 | Fenshaw et al. | |
| 3,103,027 | A | | 9/1963 | Birch | 15/110 |
| 3,110,052 | A | | 11/1963 | Whitman | 15/117 |
| 3,133,546 | A | | 5/1964 | Dent | 132/120 |
| 3,181,193 | A | | 5/1965 | Nobles et al. | 15/114 |
| 3,195,537 | A | | 7/1965 | Blasi | 128/56 |
| 3,230,562 | A | | 1/1966 | Birch | 15/110 |
| 3,231,925 | A | | 2/1966 | Conder | 15/605 |
| 3,233,272 | A | * | 2/1966 | Pambello | 15/182 |
| 3,261,354 | A | | 7/1966 | Shpuntoff | 128/173 |
| 3,359,588 | A | | 12/1967 | Kobler | 15/110 |
| 3,400,417 | A | | 9/1968 | Moret | 15/22 |
| 3,491,396 | A | | 1/1970 | Eannarino et al. | 15/104.94 |
| 3,553,759 | A | | 1/1971 | Kramer et al. | 15/110 |
| 3,563,233 | A | | 2/1971 | Bodine | 128/36 |
| 3,570,726 | A | | 3/1971 | Pomodoro | 222/546 |
| 3,641,610 | A | | 2/1972 | Lewis, Jr. | 15/114 |
| 3,939,522 | A | | 2/1976 | Shimizu | 15/244 R |
| 3,969,783 | A | | 7/1976 | Shipman | 15/250.04 |
| 3,977,084 | A | | 8/1976 | Sloan | 32/59 |
| 3,992,747 | A | | 11/1976 | Hufton | 15/321 |
| 4,090,647 | A | | 5/1978 | Dunning | 222/543 |
| 4,115,893 | A | | 9/1978 | Nakata et al. | 15/110 |
| 4,128,910 | A | | 12/1978 | Nakata et al. | 15/110 |
| 4,167,794 | A | | 9/1979 | Pomeroy | 15/188 |
| 4,277,862 | A | | 7/1981 | Weideman | 15/110 |
| 4,288,883 | A | | 9/1981 | Dolinsky | 15/110 |
| 4,428,091 | A | | 1/1984 | Janssen | 15/167 A |
| 4,458,374 | A | | 7/1984 | Hukuba | 15/22 R |
| 4,573,920 | A | | 3/1986 | d'Argembeau | 433/141 |
| 4,585,416 | A | | 4/1986 | DeNiro et al. | 433/140 |
| 4,610,043 | A | | 9/1986 | Vezjak | 15/111 |
| 4,691,405 | A | | 9/1987 | Reed | 15/201 |
| 4,763,380 | A | | 8/1988 | Sandvick | 15/160 |
| 4,812,070 | A | | 3/1989 | Marty | 401/289 |
| 4,827,551 | A | | 5/1989 | Maser et al. | 15/24 |
| 4,866,806 | A | | 9/1989 | Bedford | 15/104.94 |
| 4,887,924 | A | | 12/1989 | Green | 401/261 |
| 4,913,133 | A | | 4/1990 | Tichy | 128/62 |
| 4,929,180 | A | | 5/1990 | Moreschini | 433/166 |
| 5,005,246 | A | | 4/1991 | Yen-Hui | 15/111 |
| 5,032,082 | A | | 7/1991 | Herrera | 433/141 |
| 5,040,260 | A | | 8/1991 | Michaels | 15/167.1 |
| D326,019 | S | | 5/1992 | Spangler et al. | D4/118 |
| 5,211,494 | A | | 5/1993 | Baijnath | 401/28 |
| 5,226,197 | A | | 7/1993 | Nack et al. | 15/111 |
| 5,249,327 | A | | 10/1993 | Hing | 15/104.94 |
| 5,283,921 | A | | 2/1994 | Ng | 15/22.1 |
| 5,289,605 | A | | 3/1994 | Armbruster | 15/97.1 |
| 5,335,389 | A | | 8/1994 | Curtis et al. | 15/167.1 |
| 5,341,537 | A | | 8/1994 | Curtis et al. | 15/167.1 |
| 5,354,594 | A | * | 10/1994 | Naito et al. | 428/122 |
| 5,438,726 | A | | 8/1995 | Leite | 15/105 |
| 5,491,863 | A | | 2/1996 | Dunn | 15/106 |
| 5,528,793 | A | | 6/1996 | Schbot | 15/245 |
| 5,535,474 | A | | 7/1996 | Salazar | 15/110 |
| 5,584,690 | A | | 12/1996 | Maassarani | 433/125 |
| 5,604,951 | A | | 2/1997 | Shipp | 15/167.1 |
| 5,628,082 | A | | 5/1997 | Moskovich | 15/110 |
| 5,669,097 | A | | 9/1997 | Klinkhammer | 15/167.1 |
| 5,689,850 | A | | 11/1997 | Shekalim | 15/22.1 |
| 5,711,759 | A | | 1/1998 | Smith et al. | 601/139 |
| 5,735,011 | A | | 4/1998 | Asher | 15/167.1 |
| 5,799,353 | A | | 9/1998 | Oishi et al. | 15/167.1 |
| 5,802,656 | A | | 9/1998 | Dawson et al. | 15/110 |
| 5,806,127 | A | | 9/1998 | Samoil et al. | 15/104.94 |
| 5,810,856 | A | | 9/1998 | Tveras | 606/161 |
| D402,116 | S | | 12/1998 | Magloff et al. | D4/104 |
| D403,510 | S | | 1/1999 | Menke et al. | D4/104 |
| 5,896,614 | A | | 4/1999 | Flewitt | 15/167.1 |
| 5,930,860 | A | | 8/1999 | Shipp | 15/110 |
| 5,966,771 | A | | 10/1999 | Stroud | 15/117 |
| 5,970,564 | A | | 10/1999 | Inns et al. | 15/201 |
| 5,980,542 | A | | 11/1999 | Saldivar | 606/161 |
| 5,991,959 | A | | 11/1999 | Raven et al. | 15/201 |
| 6,021,541 | A | | 2/2000 | Mori et al. | 15/167.1 |
| 6,032,322 | A | | 3/2000 | Forsline | 15/245.1 |
| 6,041,467 | A | | 3/2000 | Roberts et al. | 15/167.1 |
| D422,143 | S | | 4/2000 | Beals et al. | D4/104 |
| 6,044,514 | A | | 4/2000 | Kaneda et al. | 15/167.1 |
| D424,808 | S | | 5/2000 | Beals et al. | D4/104 |
| D425,306 | S | | 5/2000 | Beals et al. | D4/104 |
| 6,065,890 | A | | 5/2000 | Weitz | 401/146 |
| 6,067,684 | A | | 5/2000 | Kweon | 15/167.1 |

| | | | | |
|---|---|---|---|---|
| 6,077,360 | A | 6/2000 | Takashima | 134/6 |
| 6,088,869 | A | 7/2000 | Kaneda et al. | 15/167.1 |
| 6,099,309 | A | 8/2000 | Cardarelli | 433/125 |
| 6,108,854 | A | 8/2000 | Dingert | 15/188 |
| 6,115,871 | A | 9/2000 | Royer | 15/167.2 |
| 6,126,533 | A | 10/2000 | Johnson et al. | 451/527 |
| 6,151,745 | A | 11/2000 | Roberts et al. | 15/167.1 |
| 6,151,746 | A | 11/2000 | Lewis, Jr. | 15/187 |
| 6,168,434 | B1 | 1/2001 | Bohm-Van Diggelen | 433/141 |
| 6,182,323 | B1 | 2/2001 | Bahten | 15/230.16 |
| 6,182,365 | B1 | 2/2001 | Tseng et al. | 30/34.2 |
| 6,190,367 | B1 | 2/2001 | Hall | 604/290 |
| 6,219,874 | B1 | 4/2001 | van Gelder et al. | 15/167.1 |
| 6,240,590 | B1 | 6/2001 | Nesbit | 15/210.1 |
| 6,245,032 | B1 | 6/2001 | Sauer et al. | 601/162 |
| 6,254,390 | B1 | 7/2001 | Wagner | 433/216 |
| 6,272,713 | B1 | 8/2001 | Lotwin | 15/104.061 |
| 6,276,021 | B1 | 8/2001 | Hohlbein | 15/167.1 |
| 6,299,508 | B1 | 10/2001 | Gagliardi et al. | 451/28 |
| 6,311,358 | B1 | 11/2001 | Soetewey et al. | 15/110 |
| 6,311,360 | B1 | 11/2001 | Lanvers | 15/191.1 |
| 6,319,332 | B1 | 11/2001 | Gavney, Jr. et al. | 134/6 |
| 6,421,867 | B1 | 7/2002 | Weihrauch | 15/28 |
| 6,446,295 | B1 | 9/2002 | Calabrese | 15/28 |
| 6,463,619 | B2 | 10/2002 | Gavney, Jr. | 15/117 |
| 6,510,575 | B2 | 1/2003 | Calabrese | 15/22.1 |
| 6,513,182 | B1 | 2/2003 | Calabrese et al. | 15/110 |
| 6,571,417 | B1 | 6/2003 | Gavney, Jr. et al. | 15/117 |
| 6,599,048 | B2 | 7/2003 | Kuo | 401/269 |
| 6,643,886 | B2 | 11/2003 | Moskovich et al. | 15/167.1 |
| 6,647,585 | B1 | 11/2003 | Robinson | 15/322 |
| D483,184 | S | 12/2003 | Geiberger et al. | D4/104 |
| 6,658,688 | B2 | 12/2003 | Gavney, Jr. | 15/117 |
| 6,658,692 | B2 | 12/2003 | Lenkiewicz et al. | 15/320 |
| 6,668,418 | B2 | 12/2003 | Bastien | 15/245 |
| 6,725,493 | B2 | 4/2004 | Calabrese et al. | 15/110 |
| 6,813,793 | B2 | 11/2004 | Eliav et al. | 15/22.2 |
| 6,817,054 | B2 | 11/2004 | Moskovich et al. | 15/167.1 |
| 6,820,299 | B2 | 11/2004 | Gavney, Jr. | 15/117 |
| 6,820,300 | B2 | 11/2004 | Gavney, Jr. | 15/117 |
| 6,859,969 | B2 | 3/2005 | Gavney, Jr. | 15/117 |
| 6,865,767 | B1 | 3/2005 | Gavney, Jr. | 15/114 |
| 6,886,207 | B1 | 5/2005 | Solanki | 15/110 |
| 2001/0020314 | A1 | 9/2001 | Calabrese | 15/22.1 |
| 2001/0039689 | A1 | 11/2001 | Gavney, Jr. | 15/117 |
| 2002/0124337 | A1 | 9/2002 | Calabrese et al. | 15/110 |
| 2003/0033680 | A1 | 2/2003 | Davies et al. | 15/22.1 |
| 2003/0033682 | A1 | 2/2003 | Davies et al. | 15/110 |
| 2003/0182746 | A1 | 10/2003 | Fattori et al. | 15/22.1 |
| 2003/0196283 | A1 | 10/2003 | Eliav et al. | 15/22.1 |
| 2004/0010869 | A1 | 1/2004 | Fattori et al. | 15/22.1 |
| 2004/0045105 | A1 | 3/2004 | Eliav et al. | 15/22.1 |
| 2004/0060132 | A1 | 4/2004 | Gatzemeyer et al. | 15/22.1 |
| 2004/0060133 | A1 | 4/2004 | Eliav | 15/22.1 |
| 2004/0060135 | A1 | 4/2004 | Gatzemeyer et al. | 15/22.1 |
| 2004/0060136 | A1 | 4/2004 | Gatzemeyer et al. | 15/22.1 |
| 2004/0060137 | A1 | 4/2004 | Eliav | 15/22.1 |
| 2004/0154112 | A1 | 8/2004 | Braun et al. | 15/22.1 |
| 2004/0200016 | A1 | 10/2004 | Chan et al. | 15/22.1 |
| 2005/0000048 | A1 | 1/2005 | Hohlbein | 15/110 |
| 2005/0015907 | A1 | 1/2005 | Georgi et al. | 15/167.1 |
| 2005/0049155 | A1 | 3/2005 | Gavney, Jr. et al. | 510/108 |
| 2005/0060822 | A1 | 3/2005 | Chenvainu et al. | 15/28 |
| 2005/0102780 | A1 | 5/2005 | Hohlbein | 15/110 |
| 2005/0102783 | A1 | 5/2005 | Hohlbein | 15/167.1 |

FOREIGN PATENT DOCUMENTS

| | | | |
|---|---|---|---|
| DE | 31 14 507 | A1 | 3/1983 |
| DE | 298 16 488 | U1 | 1/1999 |
| DE | 199 57 639 | A1 | 6/2001 |
| EP | 0 360 766 | A1 | 3/1990 |
| EP | 0 435 329 | A2 | 7/1991 |
| FR | 2 636 818 | | 3/1990 |
| FR | 2 793 136 | | 11/2000 |
| GB | 2 040 161 | A | 8/1980 |
| GB | 2 214 420 | A | 9/1989 |
| GB | 2 319 170 | A | 5/1998 |
| GB | 2 371 217 | A | 7/2002 |
| JP | 9-140456 | | 3/1997 |
| WO | WO 96/15696 | | 5/1996 |
| WO | WO 96/20654 | | 7/1996 |
| WO | WO 96/28994 | | 9/1996 |
| WO | WO 97/16995 | | 5/1997 |
| WO | WO 98/18364 | | 5/1998 |
| WO | WO 98/22000 | | 5/1998 |
| WO | WO 99/37181 | | 7/1999 |
| WO | WO 00/49911 | | 8/2000 |
| WO | WO 00/64307 | | 11/2000 |
| WO | WO 00/76369 | A2 | 12/2000 |
| WO | WO 01/01817 | A1 | 1/2001 |
| WO | WO 01/21036 | A1 | 3/2001 |
| WO | WO 03/030680 | A1 | 4/2003 |
| WO | WO 03/043459 | A2 | 5/2003 |
| WO | WO 2004/041023 | A2 | 5/2004 |
| WO | WO 2004/064573 | A1 | 8/2004 |

OTHER PUBLICATIONS

The Gillette Company, 2004 Annual Report and 2005 Proxy Statement.

* cited by examiner

DEVICE WITH MULTI-STRUCTURAL CONTACT ELEMENTS

RELATED APPLICATIONS

This application is a Continuation Application of the application Ser. No. 09/957,302, titled "DEVICE WITH MULTI-STRUCTURAL CONTACT ELEMENTS", filed Sep. 19, 2001 now U.S. Pat. No. 6,865,767, which claims priority under 35 U.S.C. 119 (e) of the U.S. Provisional Patent Application Ser. No. 60/233,580, filed Sep. 19, 2000, and titled "APPARATUS WITH MULTI-STRUCTURAL CONTACT ELEMENTS". The application Ser. No. 09/957,302, titled "DEVICE WITH MULTI-STRUCTURAL CONTACT ELEMENTS", filed Sep. 19, 2001 and the Provisional Patent Application Ser. No. 60/233,580, filed Sep. 19, 2000, and titled "APPARATUS WITH MULTI-STRUCTURAL CONTACT ELEMENTS" are both hereby incorporated by reference.

FIELD OF THE INVENTION

This invention relates generally to devices with contact elements. More specifically, the invention relates to devices with resilient contact elements.

BACKGROUND

Devices with resilient contact elements are typically used to clean surfaces or to apply cleaners and other materials to surfaces. For example, brush devices have bristle contact elements. The bristles are provided in the appropriate configuration and are chosen with the appropriate geometry, flexibility, hardness and resiliency to suit the intended purpose. A paintbrush is typically configured with long flexible bristles that conform to surfaces and facilitate the application of paints to surfaces. Other brush devices are configured with short rigid bristles to scour, scrub or clean surfaces.

Sponges and other absorbent materials are also used as resilient contact elements. Sponges and related materials are typically soft and used in cleaning devices and applicator devices.

Squeegees are also used in contact devices. Because squeegees are often made from non-absorbent materials, such as rubber, they are not generally used in applicator devices. Squeegees are flexible and resilient and tend to be too soft to be used in scrubbing or scouring devices. Squeegees are most commonly used to wipe or squeegee water and water solutions from smooth glass surfaces.

There have been attempts to combine the cleaning properties of an absorbent sponge-like element with a squeegee element. In the U.S. Pat. No. 6,065,890 issued to Weitz, Weitz describes a cleaning device with a squeegee element and a sponge element attached to a yoke support for combining washing and wiping.

Devices with brush-like contact elements molded form non-absorbent rubber-like materials have also been described. For example, in the U.S. Pat. No. 5,966,771, issued to Stroud, Stroud describes a polymeric sweeping device that is formed from a polymeric head with a soft polymeric bristle portion. In the U.S. Pat. No. 6,032,322, issued to Florsline, Florsline describes a device with a silicone tip configured to be used as a paint applicator or an artist's tool.

Molded rubber-like or resilient contact elements have also been described in dentition cleaning and oral care devices. In the U.S. Pat. No. 5,032,082 issued to Herrera, Herrera describes a device for removing adhesives from the palate.

The device is configured with a plurality of rubber nodules having resiliencies that are sensitive to temperature. Tveras, in the U.S. Pat. No. 5,810,556, discloses an oral hygiene device configured with a plurality of wiping elements at one end of the device and a brush section at the other end; the wiping elements being configured for scraping plaque from the tongue. In the U.S. Pat. No. 6,067,684, issued to Kweon, Kweon describes a toothbrush with silicone rubber bristles. The silicone bristles are plate shaped bristles extending in a parallel arrangement along the sides of the cleaning head. The cleaning head is attached to a handle through a hole in the handle. In the U.S. Pat. No. 4,584,416 issued to DeNiro et al., DeNiro et al. describe a resilient chewing device for cleaning teeth and gums. The device is a spool-shaped member formed a resilient material. The interior regions of the spool have protrusions to facilitate the cleaning of gums and teeth when a user chews on the device. The U.S. Pat. No. 5,970,564, issued to Inns et al., describes bristle sections that are coupled through an elastomeric bridge. The elastomeric bridge provides for the ability to anchor sets of bristles that are attached to a flexible platform. Mori et al., in U.S. Pat. No. 6,021,541, describe a toothbrush with composite monofiliment fibers. The composite monofiliment fibers have a polyester sheath with 2-5 polyamide cores. The polyamide cores protrude from the composite cores by a predetermined distance.

SUMMARY

The current invention is directed to a device with at least one resilient contact element. The device of the instant invention is configured for applying materials to a surface, cleaning a surface, texturing materials or massaging tissues. The contact element has a least two structures. For this description and for simplicity of understanding, the invention is described in terms of primary and secondary structures. Primary structures refer to structures that protrude from a supporting non-contact structure or portion thereof, such as a handle or a cleaning head. Secondary structures refer to structures that are coupled to primary structures such that the secondary structures exhibit cooperative displacement with the primary structure. Preferably, both the primary and the secondary structure contribute to the contact properties of the contact elements.

The primary structure and the secondary structure are made of the same material or of different materials. The primary structure and the secondary structure are formed in multiple steps, as a monolithic element, or in parts that are later attached. A device in accordance with the instant invention is configured with any number contact elements depending on the intended use. Further, it is understood that contact elements and the corresponding supporting structure or structures of the device are monolithic or formed in parts.

The primary and secondary structures are preferably formed from resilient materials such as plastics, elastomers, rubber or rubber-like materials. However, in an embodiment of the instant invention the secondary structure comprises metal bristles. The primary and the secondary structure are, nodule structures, arrays of nodules, squeegee structures, squeegee matrix structures, bristles and combinations thereof. The contact surfaces provided by the device of the instant invention are configured to be collectively planar, curved or three-dimensional. The primary structure preferably protrudes from a support structure by a distance in a range of 0.2 to 6.0 mm. The maximum thickness of any nodule protrusion, squeegee wall, or matrix wall is preferably not greater that 2.0 mm and is more preferably less than 1.0 mm and greater than 0.3 mm. However, it is clear that contact devices with contact elements of larger dimensions than the preferred dimensions, recited herein, can have industrial applications.

The primary structure provides first contact surfaces and the secondary structure provides second contact surfaces. Preferably, the primary structure is molded and is larger than the secondary structure, wherein the secondary structure protrudes from a surface portion of the primary structure. Accordingly, the secondary element exhibits cooperative displacement, wherein displacing the primary structure from its equilibrium resting position will also displace the secondary structure. Depending on the geometries of the structures and the material used to make the contact element, the primary structure may also exhibit cooperative displacement with the secondary structure.

According to an embodiment of the instant invention, the primary and secondary structures of a contact element are configured such that only the contact surfaces of either the primary or secondary structure will engage a working surface when a first force is applied to a working surface through the primary structure. By applying a sufficiently greater force to the working surface through the primary structure, the contact surfaces of the secondary and primary structure concurrently engage the working surface. Accordingly, multiple types of contact surfaces are provided within a single multi-structural contact element or device. Further, applying more or less force to the working surface through the contact element controls the types contact surfaces that engage the working surface.

According to another embodiment of the instant invention, the primary structure is more flexible than the secondary structure. The primary structure provides a cushion for the second structure. Thus the force that is required to deform the primary structure limits the force that may be applied to a working surface through the contact element or elements.

According to yet another embodiment of the instant invention a device is configure with a contact element having a primary structure and a secondary structure capable of engaging a working surface concurrently through out an entire range of forces applied to a working surface through the contact element.

In accordance with a preferred embodiment of the invention, the device is a dentition cleaning device. According to this preferred embodiment, the contact element has a plurality of nodules or squeegee protrusions with bristle attached thereto. The primary structure preferably has a hardness in a range of 10 to 90 Shores A as determined by a method described in Document ASTM D2240-00, Developed by the American Society for Testing Materials, entitled "Standard Test Method for Rubber Property-Durometer Hardness", the contents of which are hereby incorporated by reference. The secondary comprises bristle or sections of bristles formed from polyester, polyamide or any other suitable resin for forming fibers.

DETAILED DESCRIPTION

Although the following detailed description contains many specifics for the purposes of illustration, anyone of ordinary skill in the art will appreciate that many variations and alterations to the following details are within the scope of the invention. Accordingly, the following preferred embodiment of the invention is set forth without any loss of generality to, and without imposing limitations upon, the claimed invention.

To facilitate the clarity of the ensuing description, words listed below have been ascribed the following meanings:

1) A nodule is a protruding structure with outer surfaces.
2) A squeegee is an elongated and protruding structure, i.e. a nodule that is on the average thinner in one dimension that the other, the wider dimension being referred to herein as the elongation direction.
3) An array is a grouping of protruding structures.

4) A matrix is a protruding structure that has an extended network of edges, walls and cavities.
5) Softness is the ease with which the surface of a structure yields or deforms to an applied force.
6) Hardness is the magnitude of force required for a structure to yield or deform to an applied force as measured with durometer hardness meter and reported in units of Shore A.
7) Resiliency is the ability of a structure to return substantially to its original form or geometry after a deformation to the structure or portion thereof. Structures that substantially return to their original form or geometry quickly after a deformation are described herein, as being more resilient than those structures, which substantially return to their original form or geometry slowly after a deformation.
8) Resilient materials are materials that exhibit resiliency.
9) Flexibility is a measure of the ability of a resilient structure or a measure of the ability of a resilient structure to be displaced from an equilibrium rest position without damage to the structure. A structure that is less flexible is more rigid.

Figure 1A:
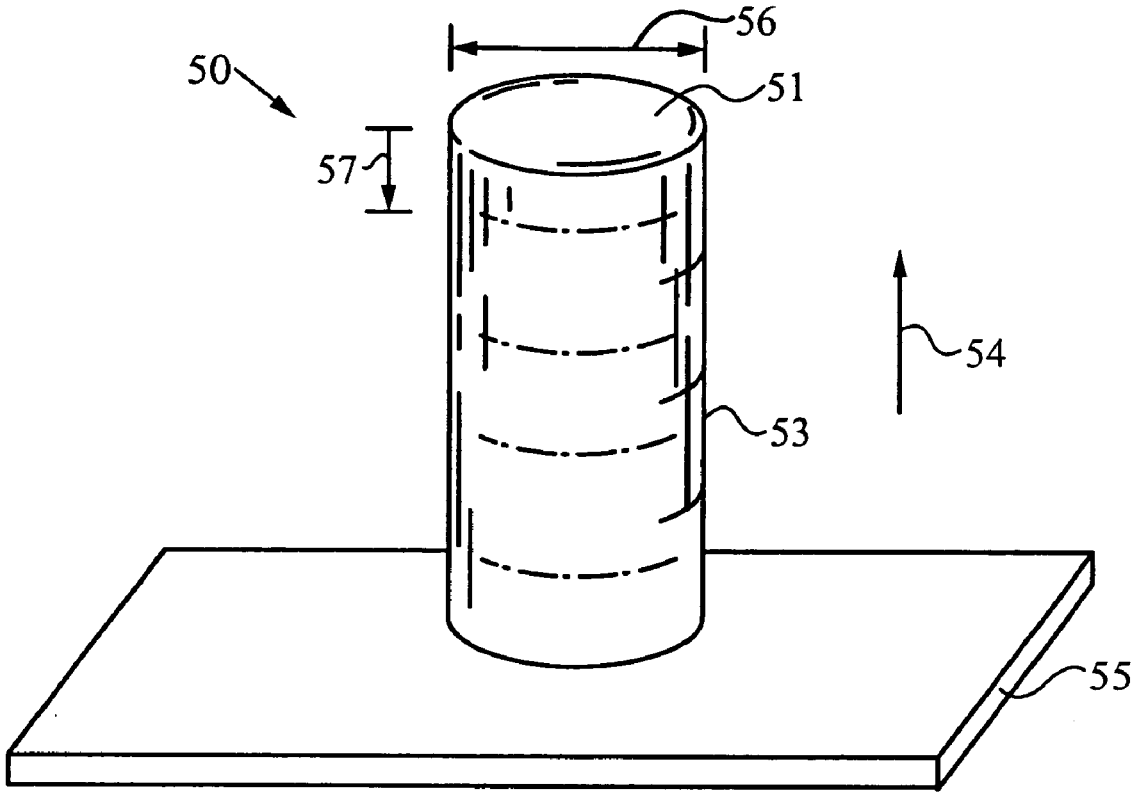
FIG. 1*a* shows an exemplary nodule structure.

FIG. 1*a* shows a typical nodule structure 50. The nodule structure protrudes from support surfaces 55 in a protruding direction 54 and preferably extends to distances in a range of 0.2 to 6.0 mm from the support surfaces 55. The nodule 53 has wall surfaces and tip surfaces 51. Preferably, the averaged thickness 56 of the nodule 50 is not greater than 2.0 mm and is most preferably less than 1.0 mm measured from distances 57 between the tip 51 of the structure 50 and 0.2 mm down from the tip 51 of the structure 50.

Figure 1B:
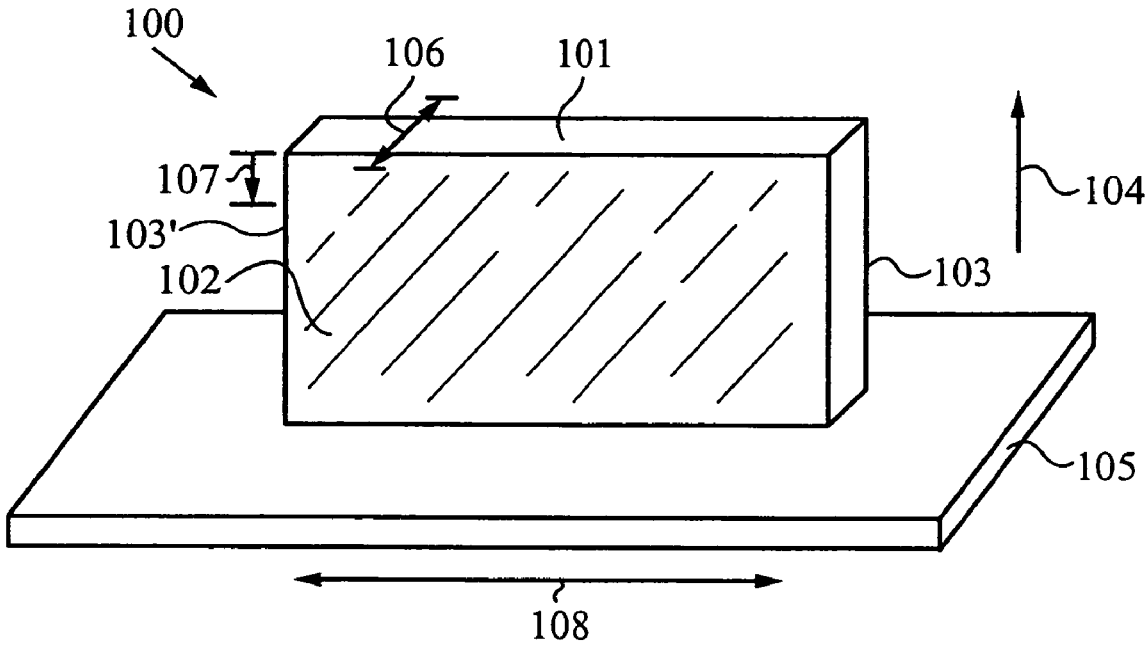
FIG. 1*b* show an exemplary squeegee structure.

FIG. 1*b* shows a section of a squeegee structure 100. The squeegee structure 100 protrudes from support surfaces 105 in a protruding direction 104 and preferably extends to distances in a range of 0.2 to 6.0 mm. The squeegee structure 100 has squeegee wall surfaces 102, squeegee edge surfaces 101 and squeegee ends 103 and 103'. According to the current invention, squeegee structures extend in the elongation direction 108 to any distance and takes on any number of shapes and forms. Squeegee structure herein refers to an elongated structure with two ends as shown in FIG. 1*b*, an elongated structure with one end, an elongated structure without ends (viz. a continues squeegee structure) and combinations thereof. Preferably, the averaged thickness 106 of the squeegee wall 102 is not greater than 2.0 mm and is most preferably less than 1.0 mm measured distances 107 between the edge surfaces 101 of the structure 100 and 0.2 mm down from the edge surfaces 101 of the structure 100.

Figure 1C:
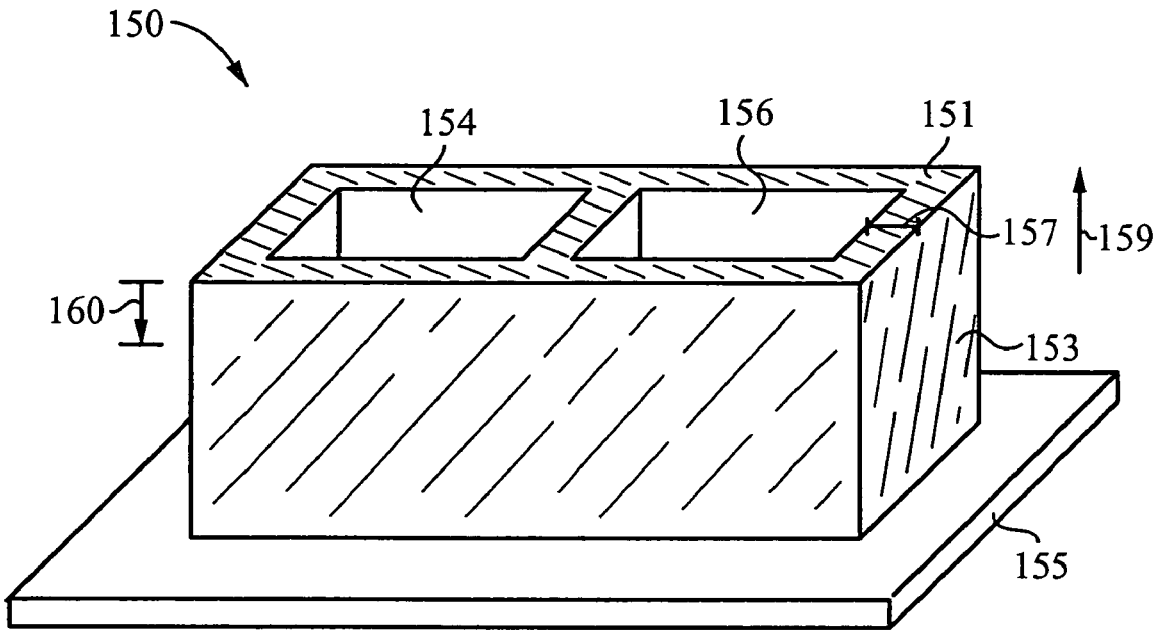
FIG. 1*c* illustrates a perspective view of a squeegee matrix.

FIG. 1*c* shows a two cavity matrix structure 150. The matrix structure 150 protrudes from support surfaces 155 in a protruding direction 159 and preferably extends to distances in a range of 0.2 to 6.0 mm. The matrix structure 150 has edge surfaces 151, wall surfaces 153, and cavities 154 and 156. Matrix structures in accordance with the instant invention have any number of geometries and shapes. The matrix structure has a symmetrical or an asymmetrical network of wall surfaces, edge surfaces and cavities. Preferably, the averaged thickness 157 of the walls 153 are not greater than 2.0 mm and is most preferably less than 1.0 mm measured from distances 160 between the edge surfaces 151 of the structure 150 and 0.2 mm down from the edge surfaces 151 of the structure 150.

According to the current invention a contact device is configured to have at least one a resilient contact element. The contact element has a primary structure that is a nodule, a squeegee, an array or a matrix. The primary structure provides for first contact surfaces that are capable of contacting a working surface. The resilient contact element has at least one secondary structure that is coupled to the primary structure. The secondary structure is capable of exhibiting cooperative displacement with the primary contact structure. Cooperative displacement, herein, refers to the displacement of one structure through the displacement of another structure. Preferably, the secondary structure protrudes from surfaces or a surface region of the primary structure. Most preferably, the secondary structure protrudes from wall surfaces, edge surfaces or tip surfaces of the primary structure. The secondary structure is a nodule, a squeegee, an array, a matrix or a bristle structure. The secondary structure provides second contact surfaces that are capable of contacting the working surface.

Both the primary and the secondary structures are preferably resilient and formed from resilient materials including, but not limited, to plastics, rubbers, silicones, urethanes latex and other elastomeric materials. The primary structure preferably has durometer hardness in a range of 10 to 90 Shores A. The secondary contact structure is preferably comprise a bristle structure. The primary structure is preferably formed by injection molding or any other suitable molding technique known in the art. The secondary structures are preferably formed by fiber drawing techniques for forming bristles from plastic resin materials. Alternatively, the secondary structure is a nodule, a squeegee, any array or matrix also formed by molding techniques. The contact element can be modified by incorporating non-resilient materials such as abrasive particles into the primary and/or secondary structures.

Figure 2A:
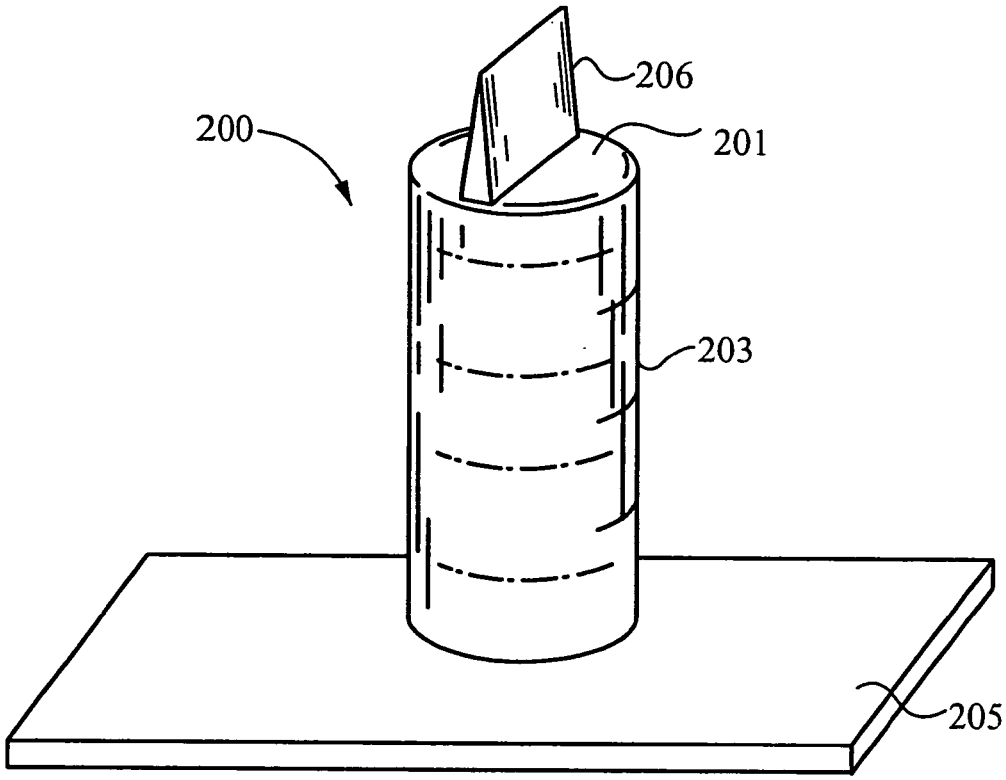
FIG. 2*a* shows a contact element with nodule structure and a squeegee structure protruding from tip surfaces of the nodule structure.

FIG. 2*a* illustrates a contact element 200 with a nodule 203 protruding from support surfaces 205. The nodule 203 has contact surfaces 201 that are capable of engaging a working surface (not shown). The contact element 200 has a squeegee structure 206 coupled to the nodule 203 and protruding from the contact surfaces 201 of the nodule 203. The squeegee structure 206 provides the contact element 200 with a second set of contact surfaces that are capable of engaging the working surface. In accordance with the instant invention, the contact element 200 will engage the working surface with the squeegee 206 when a first force is applied to the working surface through the nodule 203. When a second and sufficiently greater force is applied to the working surface through the nodule 203, surfaces of the nodule 203 will also engage the working surface.

Figure 2B:
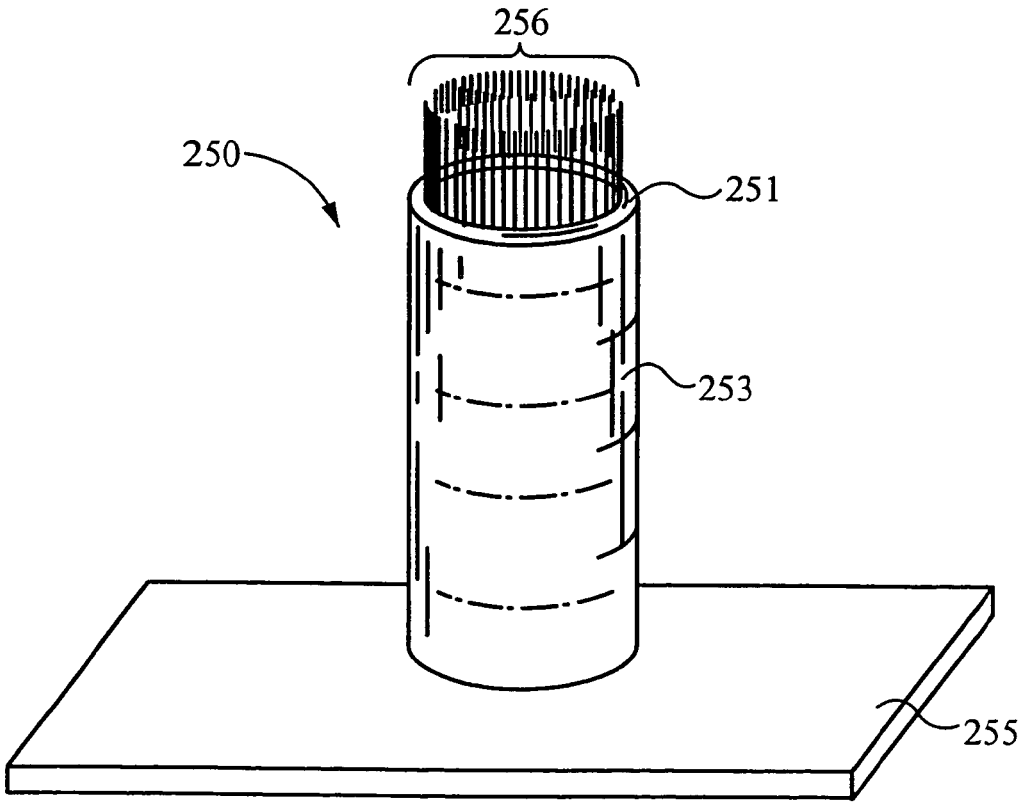
FIG. 2*b* illustrates a contact element with tubular squeegee structure and bristles protruding from edge surfaces of the squeegee structure.

FIG. 2*b* illustrates a contact element 250 with a tubular squeegee 253 protruding from support surfaces 255. The squeegee 253 has contact surfaces 251 that are capable of engaging a working surface (not shown). The contact element 250 has a bristle structure 256 coupled to the squeegee 253 and protruding from the surfaces 251 of the squeegee 253. The bristle structure 256 provides the contact element 250 with bristle surfaces that are capable of engaging the working surface. In accordance with the instant invention, the contact element 250 will engage a working surface with the bristles 256 when a first applied force is applied to the working surface through the squeegee 253. When a second, and sufficiently greater, force is applied to the working surface through the squeegee 253, surfaces 251 of the squeegee 253 will also engage the working surface.

Figure 3A:
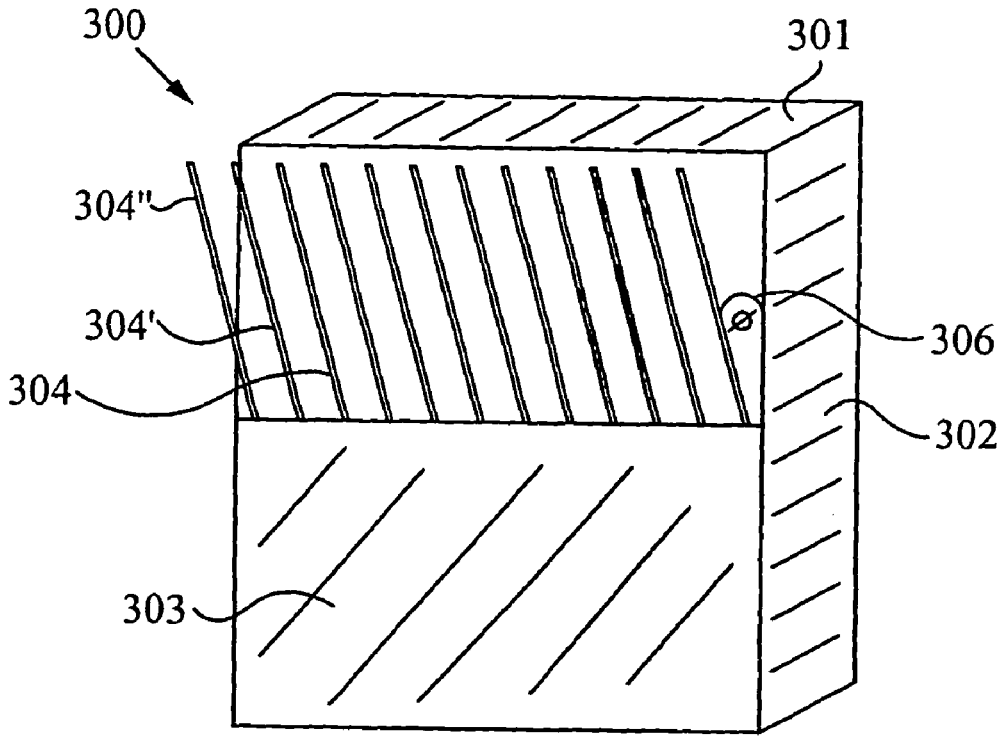
FIG. 3*a* shows a contact element with a squeegee structure and bristles protruding from wall surfaces of the squeegee structure.

FIG. 3*a* illustrates a contact element 300 with a squeegee structure 302. The squeegee structure 302 has edge surfaces 301 for engaging a working surface (not shown). Protruding from wall surfaces 303 of the squeegee 302, there are several bristles or bristle sections 304, 304' and 304". Preferably, the bristle sections 304, 304' and 304" and the squeegee surfaces 301 are cable of engaging the working surface simultaneously or individually depending on presentation angle of the contact element 300 relative to the working surface and the force that is applied to the working surface through the contact element. The contact element 300 provides the contact properties of a squeegee and bristles in a single multi-structural contact element. The bristles 304, 304' and 304" can at any angle 306 relative to the protruding wall surfaces 303 suitable for the application at hand.

Figure 3B:
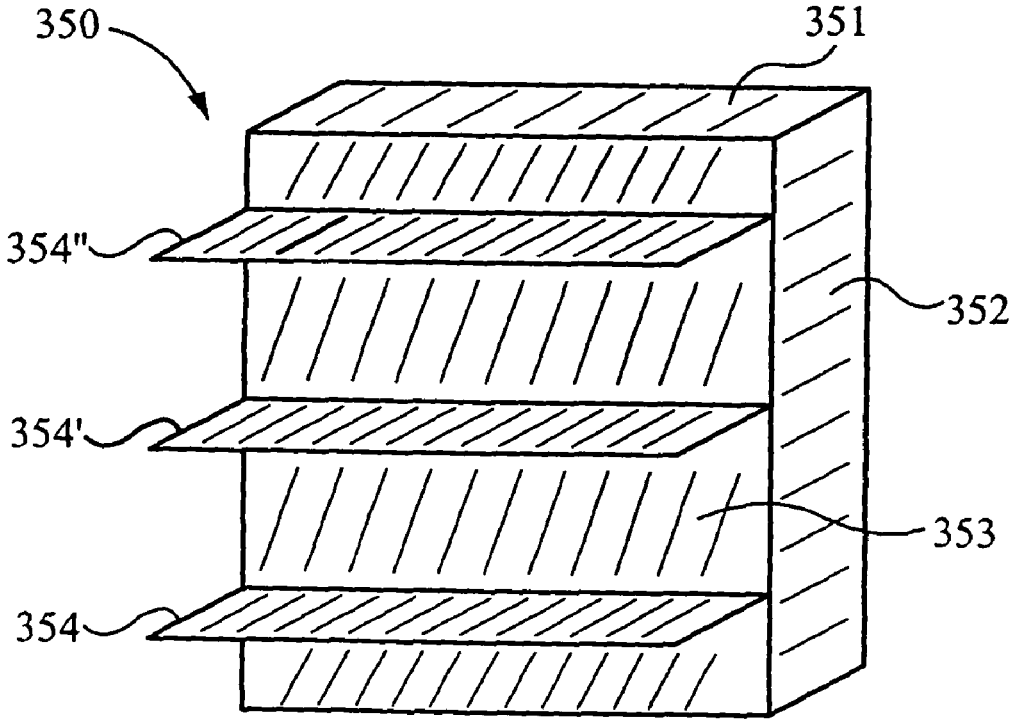
FIG. 3*b* shows a contact element with a primary squeegee structure and secondary squeegee structure protruding from wall surfaces of the primary squeegee structure.

FIG. 3*b* illustrates a contact element 350 with a squeegee structure 352. The squeegee structure 352 has edge surfaces 351 for engaging a working surface (not shown). Protruding from wall surfaces 353 of the squeegee 352 there are several secondary squeegees 354, 354' and 354". Preferably, the secondary squeegee structures 354, 354' and 354" and the squeegee surfaces 351 are cable of engaging the working surface. The secondary squeegees 304, 304' and 304" and the squeegee surfaces 351 engage the working surface simultaneously or individually depending on presentation angle of the contact element 350 relative to the working surface and the force that is applied to the working surface through the contact element as explained in detail above.

Figure 4A:
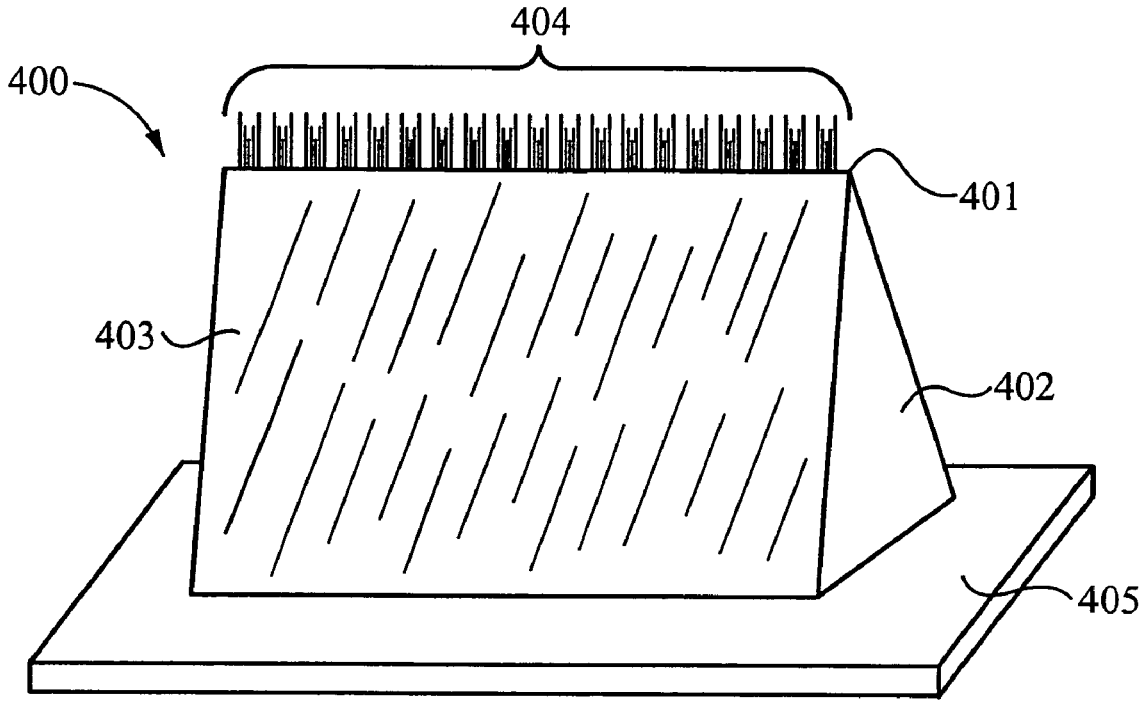
FIG. 4*a* shows a contact element with a tapered squeegee structure and bristles protruding from edge surfaces of the squeegee structure.

FIG. 4*a* illustrates a contact element 400 with a tapered squeegee 402 protruding from support surfaces 405. The squeegee 402 has wall surfaces 403 and edge surfaces 401 that are capable of engaging a working surface (not shown). The contact element 400 has a bristle structure 404 couple to the squeegee 402 and protruding from the edge surfaces 401 of the squeegee 402. The bristle structure 404 provides the contact element 400 with bristle surfaces that are also capable of engaging the working surface. The contact element 400 will engage the working surface with the bristles 404 when a first force is applied to the working surface through the squeegee 402. When a second, and sufficiently greater, force is applied to the working surface through the squeegee 401, the edge surfaces 401 and wall surfaces 403 of the squeegee 402 will also engage the working surface.

Figure 4B:
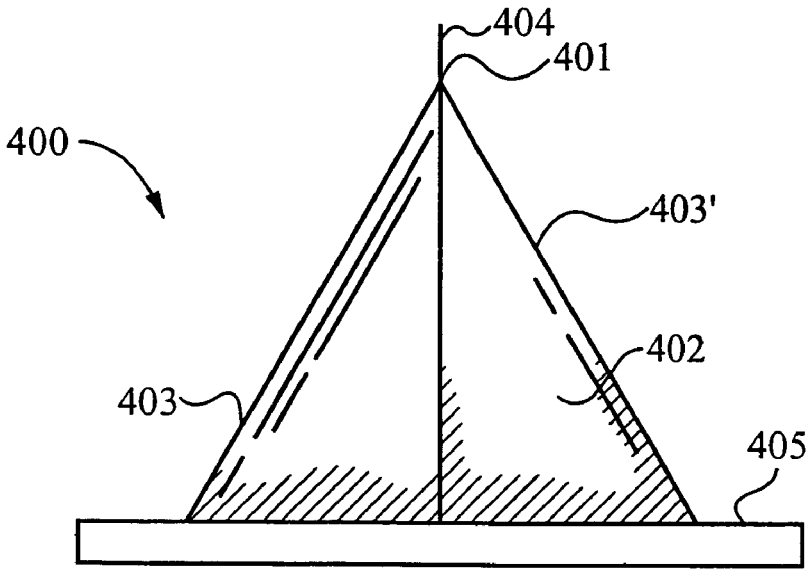
FIG. 4*b* is a cross-sectional view of the contact element shown in FIG. 4*a* illustrating a bristle extending through the squeegee structure.

FIG. 4*b* shows a cross-sectional view of the contact element 400 illustrated in the FIG. 4*b*. The tapered squeegee 402 has wall surfaces 403 and 403' and the edge surfaces 401 that are capable of engaging a working surface, as described above. The bristles 404 are preferably attached to the support 405 extend through a portion of the squeegee 402 and protrude from wall surfaces 403 and 403' or edge surfaces 401, as shown. The bristles of the bristle structure 404 are not required to extend through the entire squeegee 402 to practice the invention and may be couple to surfaces of the squeegee structure 402 by other means known in the art.

Figure 5A:
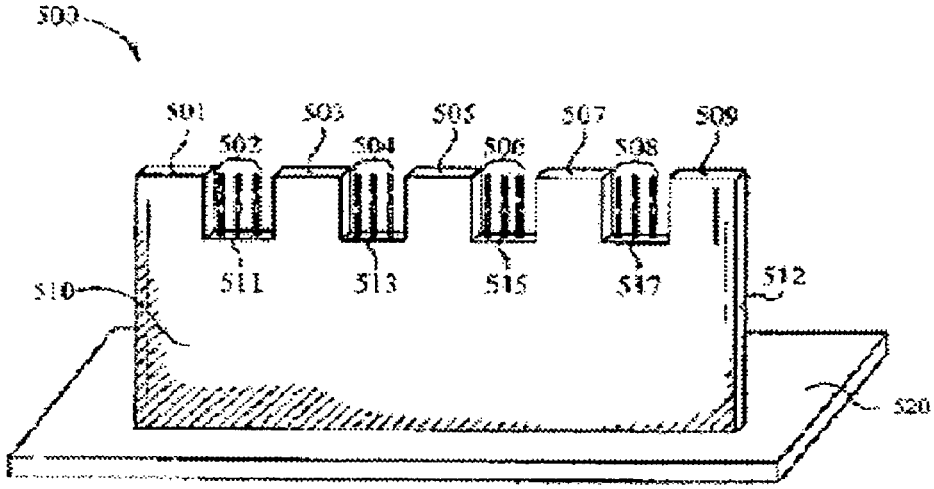
FIG. 5*a* shows a contact element with a contoured squeegee structure and with bristles protruding from between depressed regions of the contoured squeegee structure.

FIG. 5*a* illustrates a contact element 500 that has a squeegee structure 512 which protrudes from support surfaces 520 with protruding squeegee walls 510. The squeegee element 512 is contoured with teeth 501, 503, 505, 507, and 509. Between the teeth 501, 503, 505, 507, and 509 there are notches or depressions 511, 513, 515 and 517. On the surfaces of the notches 511, 513, 515 and 517 there are bristle sections 502, 504, 506 and 508, respectively. The squeegee teeth 501, 503, 505, 507, and 509 and the bristle sections 502, 504, 506 and 508 are made to be longer or shorter relative to each other depending on the application at hand. When squeegee teeth 501, 503, 505, 507, and 509 are longer than the bristle sections 502, 504, 506 and 508, as shown, then the squeegee teeth 501, 503, 505, 507, and 509 (or a portion thereof) will engage a working surface (not shown) when a first force is applied to the working surface through squeegee structure 512. When a second, and sufficiently greater, force is applied to the working surface through the squeegee structure 512, then the bristle sections 502, 504, 506 and 508 (or a portion thereof) will also contact the working surface. Alternatively, the squeegee teeth 501, 503, 505, 507, and 509 and the bristle sections 502, 504, 506 and 508 are made to have the same length such that the teeth 501, 503, 505, 507, and 509 and bristle sections 502, 504, 506 and 508 engage a working surface simultaneously. The contact device of the instant invention is configured with any number of teeth and bristles sections suitable for the application at hand.

Figure 5B:
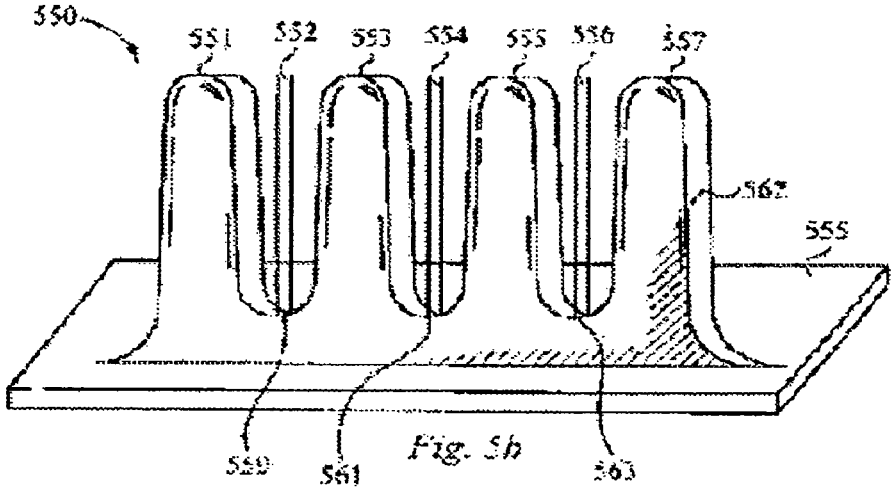
FIG. 5*b* shows a contact element with nodular protrusions and with bristles protruding from surfaces between the nodular protrusions of the contact element.

FIG. 5*b* illustrates a contact element 550 that has an extended nodular structure 562 that protrudes from support surfaces 555 with protruding nodules 551, 553, 555 and 557. Between the protruding nodules 551, 553, 555 and 557, there are depressed surfaces 559, 561, and 563. Protruding from the depressed surfaces 559, 561 and 563 there are bristle sections 552, 554, and 556. The nodules 551, 553, 555 and 557 and the bristle sections 552, 554, and 556 are made to be longer or shorter or the same, as explained above relative to each other depending on the application at hand. Alternatively, the nodules 551, 553, 555 and 557 and the bristle sections 552, 554, and 556 are made to have the same length so that the nodules 551, 553, 555 and 557 and bristle sections 552, 554, and 556 contact a working surface simultaneously. Further, the contact device of the instant invention is configured with any number of teeth and bristles sections suitable for the application at hand.

Figure 6A:
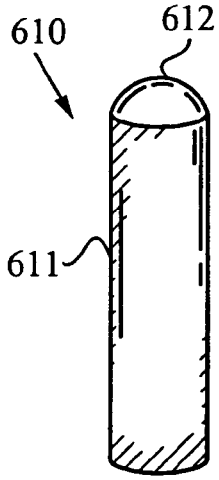
FIG. 6*a-h* illustrate several exemplary symmetrical nodular structures.
Figure 6B:
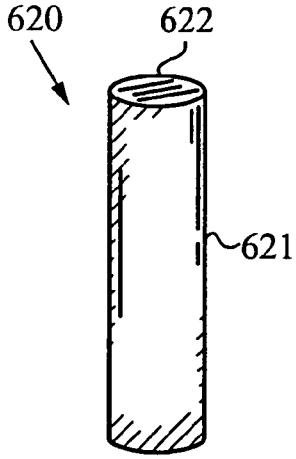
Figure 6C:
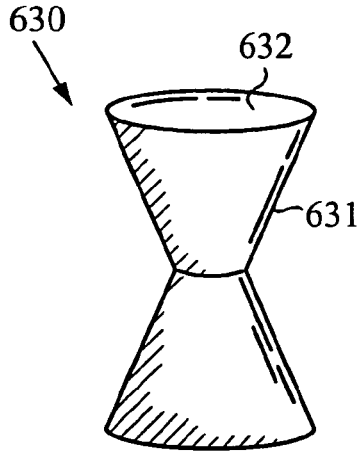
Figure 6D:
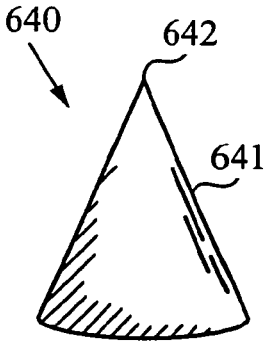
Figure 6E:
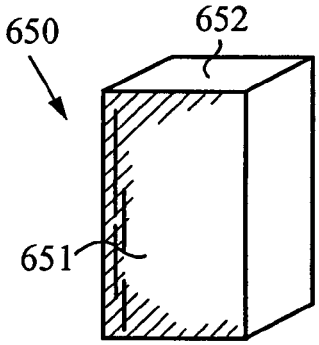
Figure 6F:
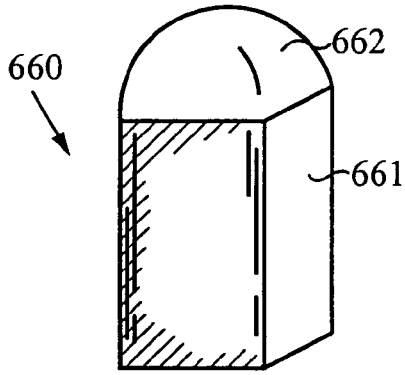
Figure 6G:
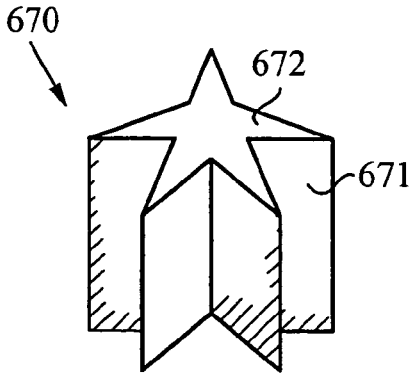
Figure 6H:
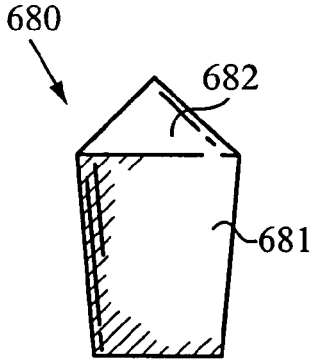

FIG. 6*a-h* illustrate several symmetrical nodule structure geometries that are useful in the contact device of the instant invention. FIG. 6*a* shows a nodule 610 with cylindrical protruding walls 611 and a rounded tip portion 612; FIG. 6*b* shows a nodule 620 with cylindrical protruding walls 621 and a flat top 622; FIG. 6*c* shows a nodule 630 with contoured protruding walls 631 and a flat top 632; FIG. 6*d* shows a pointed nodule 640 with tapered protruding walls 641 and a tip 642; FIG. 6*e* shows a rectangular nodule 650 with planar walls 651 and a flat top 652; FIG. 6*f* shows a nodule 660 with planar walls 661 and a rounded tip portion 662; FIG. 6*g* shows a star shaped nodule 670 with protruding walls 671 and a star-shaped top 672; FIG. 6*h* shows a triangular nodule 680 with protruding walls 681 and triangular-shaped top 682.

Figure 7A:
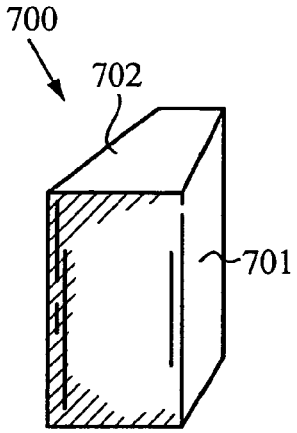
FIGS. 7*a-*7*g* illustrate several exemplary asymmetric nodular structures.
Figure 7B:
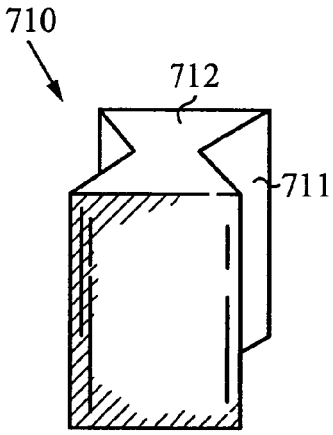
Figure 7C:
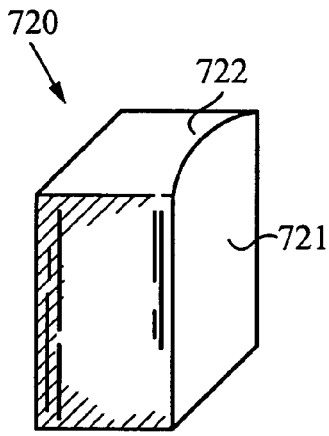
Figure 7D:
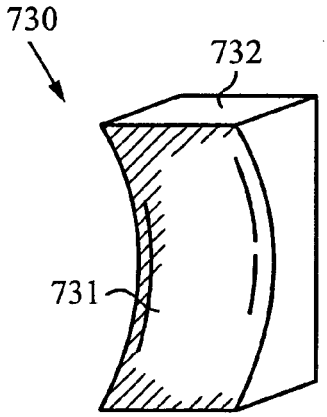
Figure 7E:
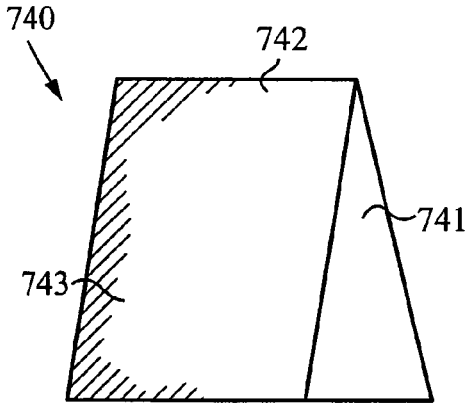
Figure 7F:
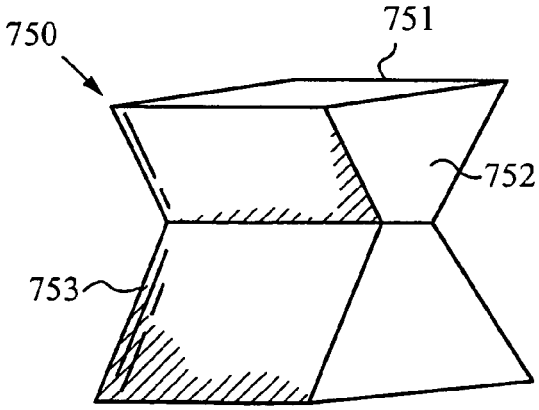
Figure 7G:
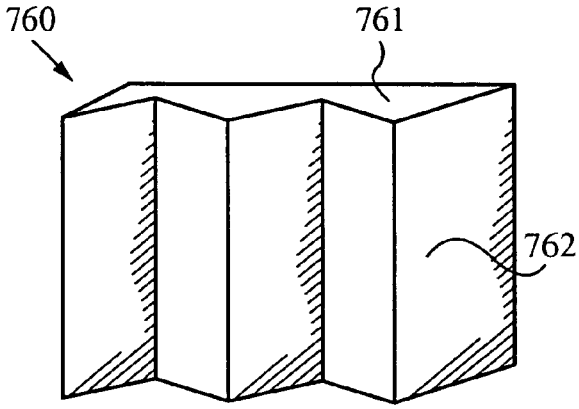

FIG. 7*a-g* illustrate several asymmetrical nodule structure geometries that are useful in the contact device of the instant invention. FIG. 7*a* shows a wedge-shaped nodule 700 with protruding walls 701 and a top 702; FIG. 7*b* shows a nodule 710 with contoured walls 711 and a bow-tie shaped top 712; FIG. 7*c* shows a curved nodule 720 with protruding walls 721 (curved in the elongation direction) and a flat top 722; FIG. 7*d* shows a curved nodule 730 with protruding walls 733 (curved in the protruding direction) and a top 732; FIG. 7*e* shows a wedge shaped nodule 740 with tapered walls 743, triangular walls 741 and an edge 742; FIG. 7*f* shows a nodule 750 with grooved walls 753, bow-tie shaped walls 752 and a flat top 751; and FIG. 7*g* shows a nodule 760 with contoured walls 762 and a top 761. It will be clear to one of average skill in the art that any number of symmetric and asymmetric nodule geometries and combinations thereof are useful in the contact device of the instant invention.

Figure 8A:
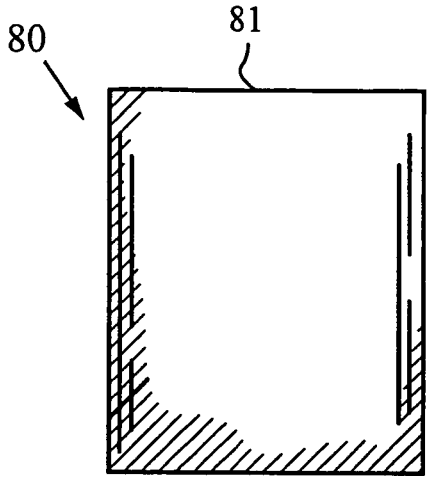
FIG. 8*a-f* illustrate several exemplary contoured tip and edge surfaces.
Figure 8B:
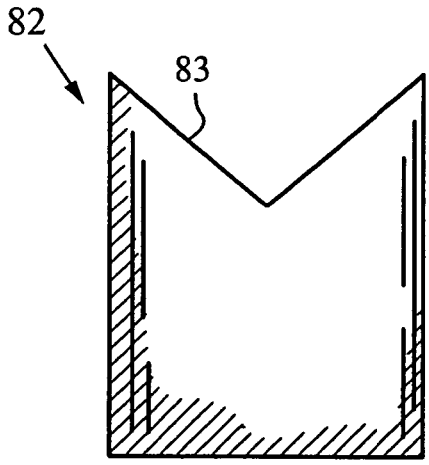
Figure 8C:
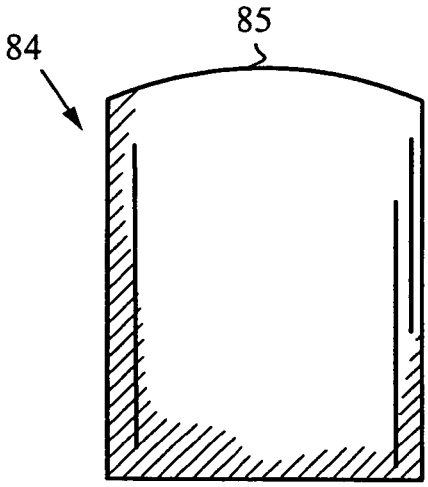
Figure 8D:
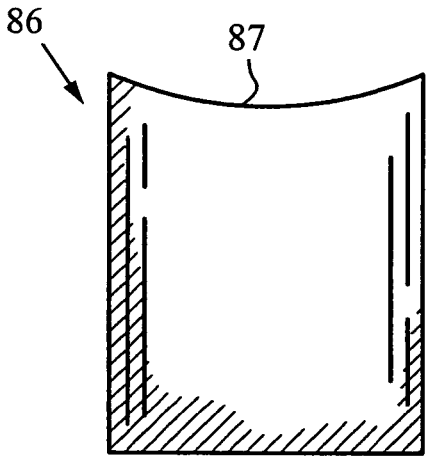
Figure 8E:
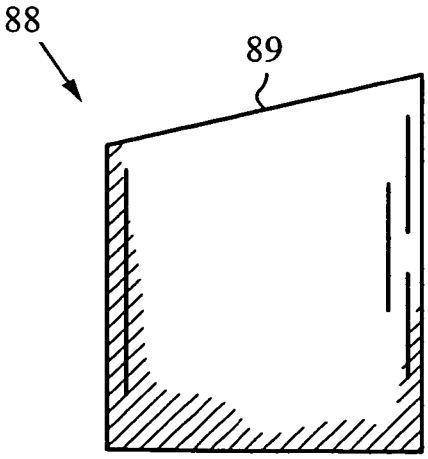
Figure 8F:
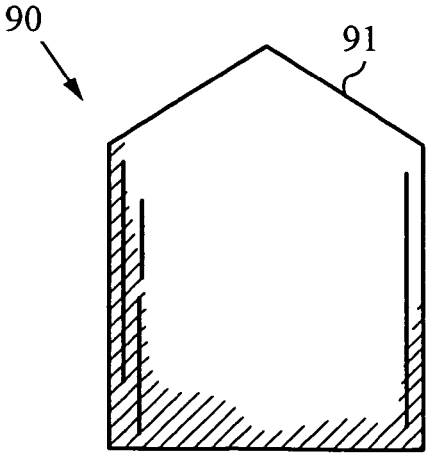

FIG. 8*a-f* illustrate several edge and tip contours of contact structures used in the instant invention. FIG. 8*a* shows a contact structure segment 80 with a planar contact edge 81; FIG. 8*b* shows a contact structure segment 82 with a V-shaped contact edge 83; FIG. 8*c* shows a contact structure segment 84 with a curve convex contoured contact edge 85; FIG. 8*d* shows a contact structure segment 86 with a concave contoured contact edge 87; FIG. 8*e* shows a contact structure segment 88 with a diagonally contoured contact edge 89; and FIG. 8*f* shows a contact structure segment 90 with a pointed contact edge 91.

Figure 9A:
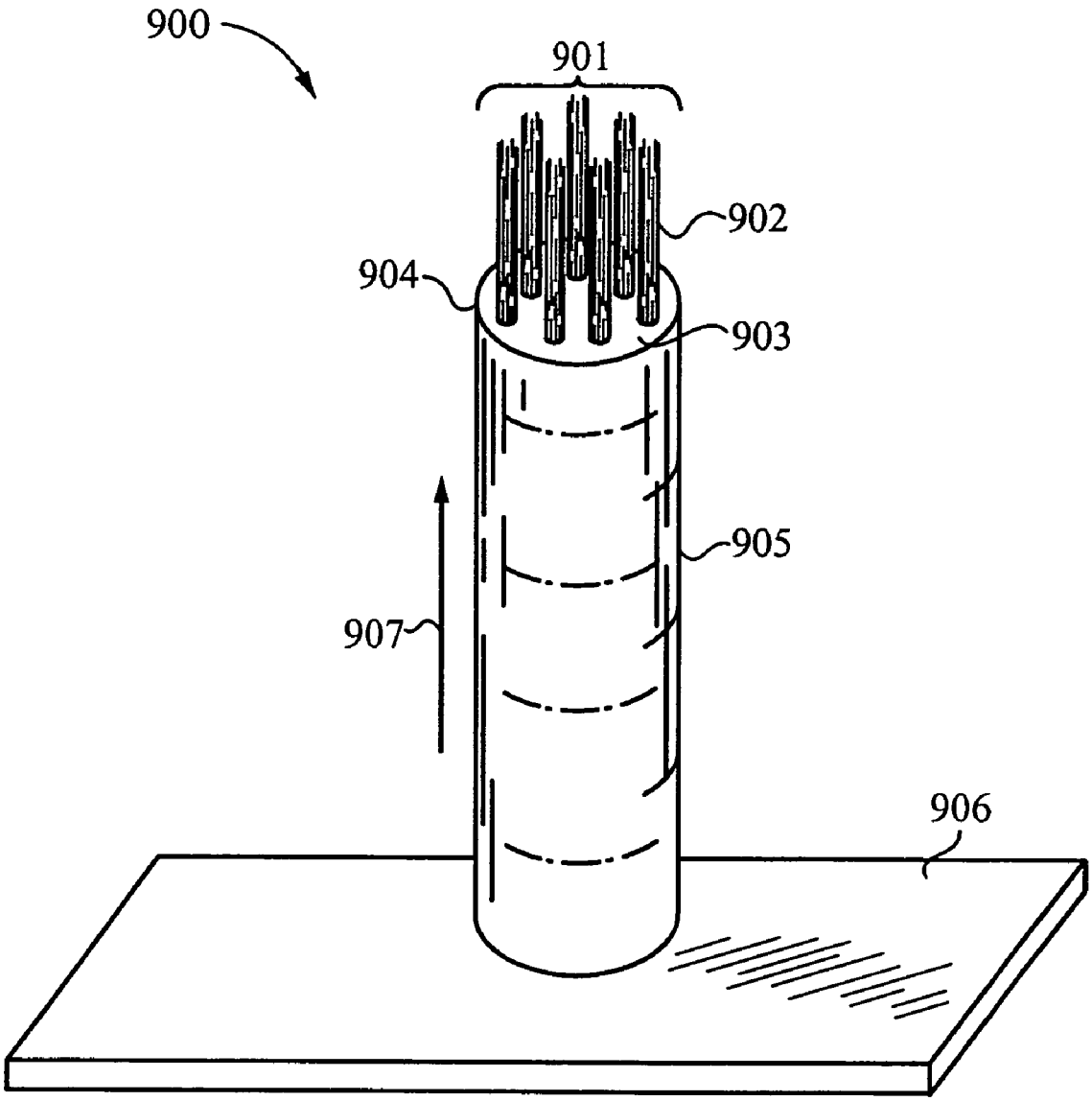
FIG. 9*a* shows a contact element with a nodular structure and a bristle structure protruding from tip surfaces of the nodular structure.

FIG. 9*a* shows a contact element 900 with a primary nodular structure 905 that protrudes from a support structure 906 in a protruding direction 907. The support structure 906 is rigid or flexible depending on the intended application. The support 906 and the nodule 905 are formed of the same or different material and are made in parts or are co-molded as a monolithic unit. According to an embodiment of the invention, a contact device has one or more contact elements or an array of contact elements such as the one shown in the FIG. 9*a*.

Still referring to the FIG. 9*a*, the contact element 900 has a bristle structure 901 comprising bristle groupings 902 protruding from top surfaces 903 of the nodule 905. Alternatively, a bristle structure protrudes from wall surfaces or edge surfaces 904 of the nodule 905 or any combination of surfaces and edges. The bristle structure 901 is comprised of bristles that are formed from resilient materials, including but not limited to, natural hair, plastics, rubbers, silicones, urethanes latex and elastomeric materials. Bristles, while typically hard, are made to be flexible and resilient by virtue of their thin elongated geometries.

Figure 9B:
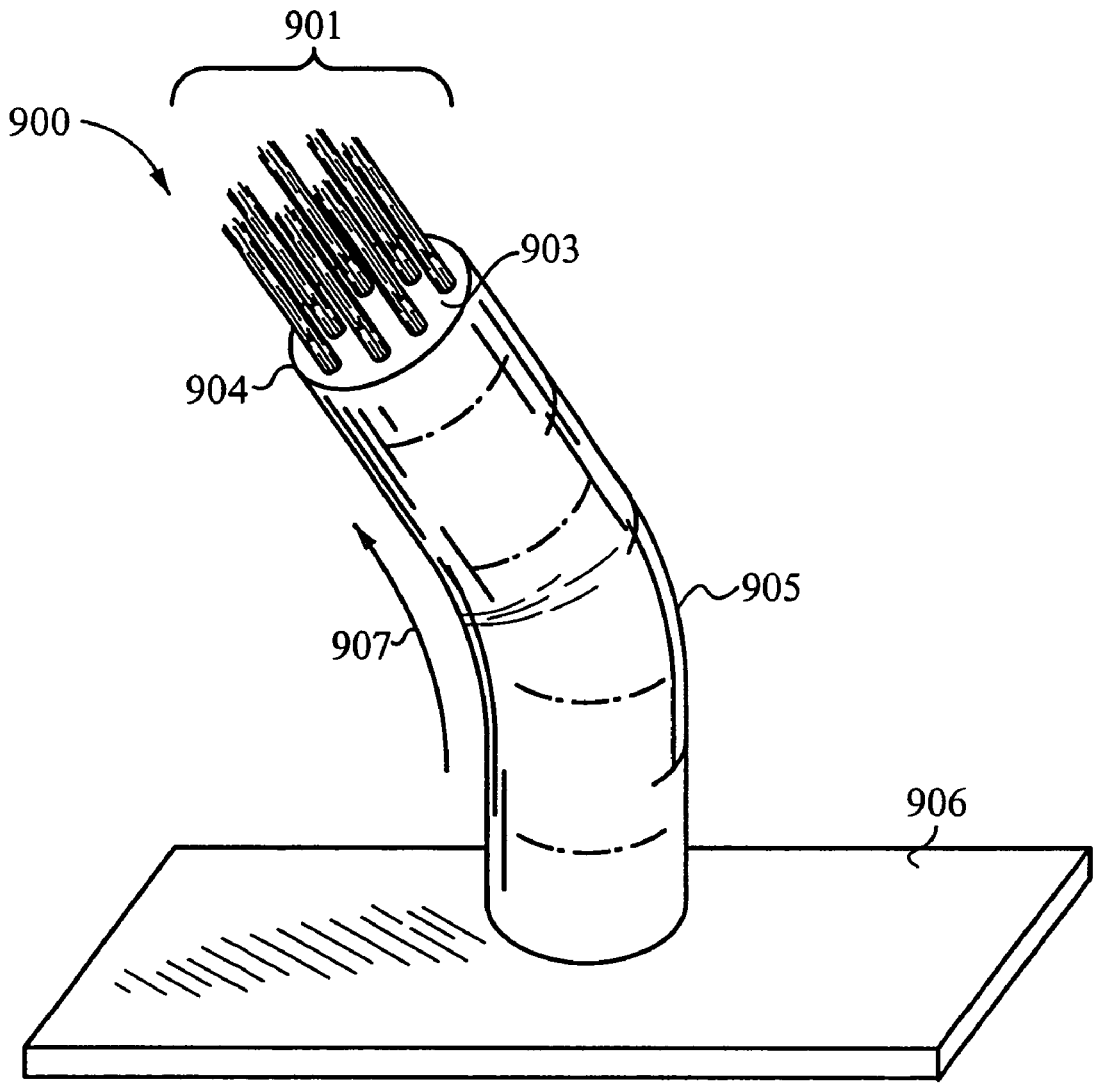
FIG. 9*b* illustrates the contact element shown in the FIG. 9*a* bending at the body portion of the nodule structure and concurrently displacing the bristle structure attached thereto.

Now referring to FIG. 9*b*, when the nodule structure 905 of the contact element 900 is displaced in the direction 907, then the bristle structure 901 exhibits cooperative displacement with the nodule structure 905. Accordingly, the contact behavior of the element 900 depends on the relative flexibility or rigidity of the primary 905 and secondary 901 contact structures. For example, when the bristle structure 901 is made to be sufficiently rigid relative to the nodule structure 905, then engaging the bristle structure 901 with a working surface (not shown) and applying a force to the working surface through the nodule 905 will cause the nodule 905 to deflect as shown in the FIG. 9*b*. Making the nodule structure 905 more flexible that the bristle structure 901 allows the nodule structure 905 to function as a cushion for the more rigid abrasive bristle structure 901. Alternatively, when the bristle structure 901 is made to be more flexible relative to the nodule structure 905, then engaging the bristle structure 901 with the working surface and applying a force to the working surface through the nodule 905 will cause the bristle structure 901 to be displaced from its equilibrium resting position. If the bristles are sufficiently flexible, then the bristles of the bristle structure 901 will be completely displaced and surfaces of the nodule 905 will also contact the working surface. When the nodule structure 905 and the bristles of the bristle structure 901 are made to exhibit similar flexibility, then engaging the bristle structure 901 with the working surface and applying a force to the working surface through the nodule 905 displaces both the nodule 905 and the bristle structure 901 from their respective equilibrium resting positions.

Figure 10A:
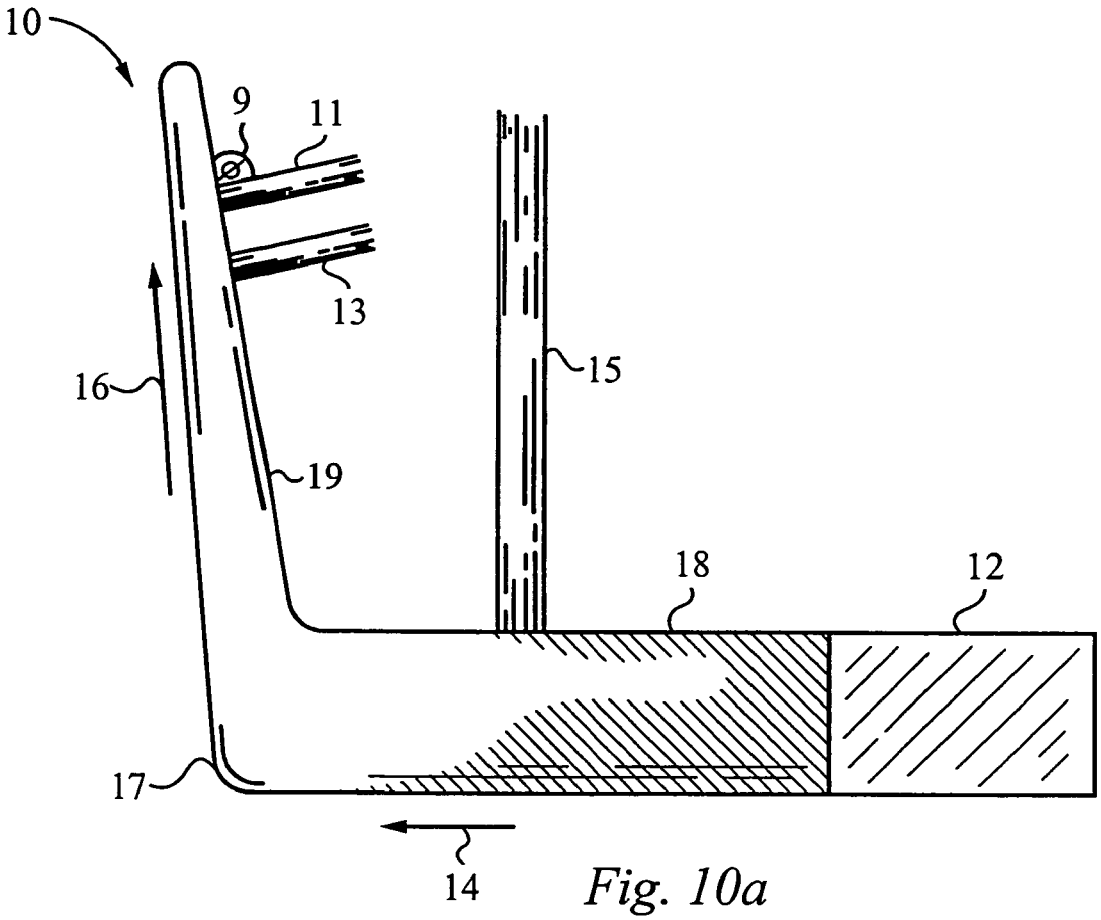
FIG. 10*a* shows a cross-sectional view of a contact element with a structure having an L-shaped cross-section and bristles protruding from inner walls of the L-shaped cross-section.

FIG. 10*a* shows a cross-sectional view of a contact element 10 in accordance with an alternative embodiment of the invention. The primary structure 17 is a bent nodule or squeegee structure. The primary structure 17 protrudes from a support structure 12 that is either rigid or flexible or a combination of rigid and flexible components. The primary structure 17 protrudes from the support 12 with a base portion 18 in a direction 14 and further extends with a wall portion 19 in a second direction 16. Protruding from the interior surfaces of the base portion 18 and the wall portion 12 of the structure 17 are bristle structures 11, 13 and 15. Depending on where the structure 17 is bent from or displaced, different groups of the bristle structures 11, 13 and 15 will exhibit cooperative displacement.

Figure 10B:
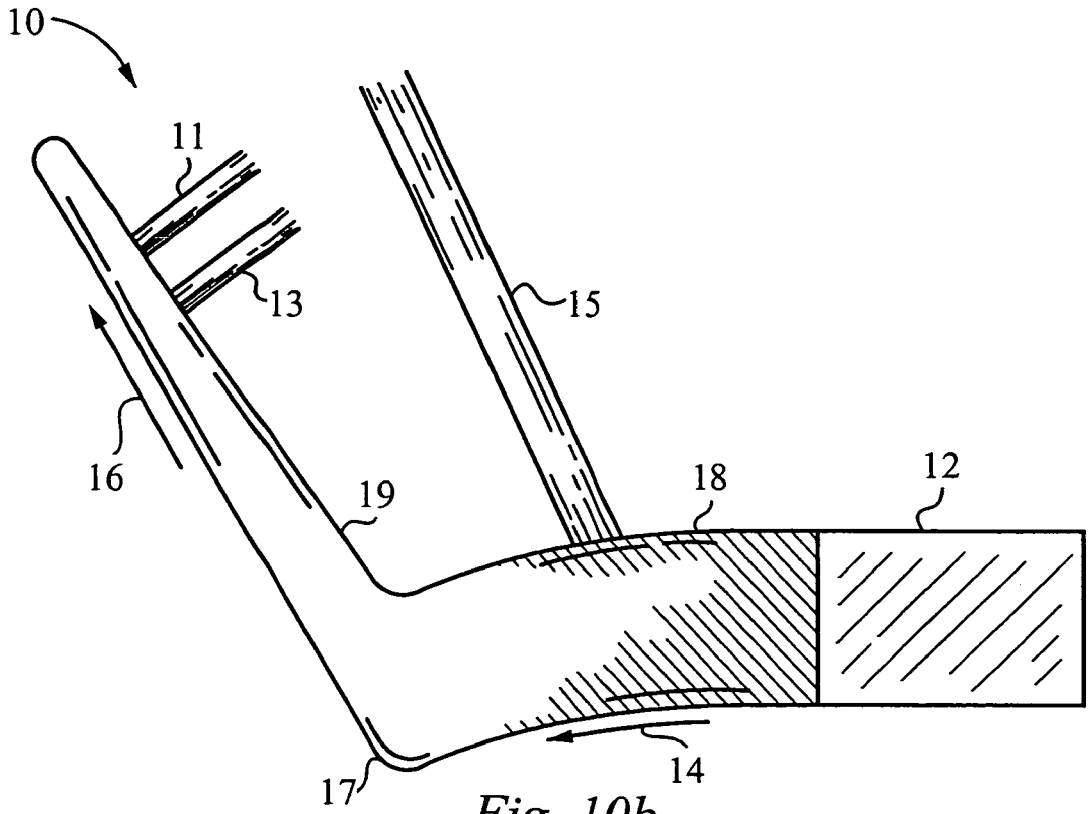
FIG. 10*b* shows cooperative displacement of bristle structures protruding from the L-shaped cross-section of the contact element illustrated in the FIG. 10*a*.
Figure 10C:
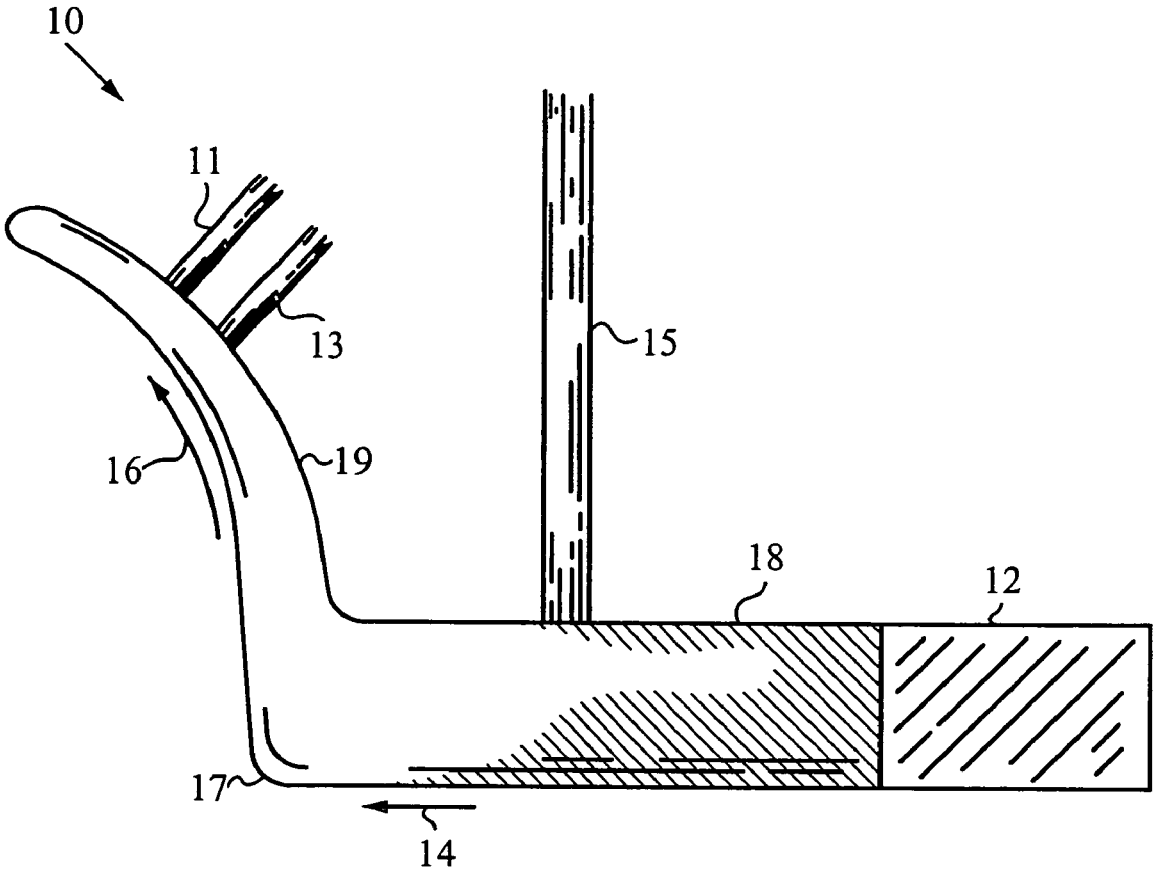
FIG. 10*c* shows cooperative displacement of a selective set of bristles protruding from the structure L-shaped cross-section of the contact element illustrated in the FIG. 10*a*.

Now referring to FIG. 10*b*, displacement of the structure 17 from its equilibrium resting position in the direction 14 will causes all of bristle structures 11 13 and 15 to be displaced as shown. Now referring to the FIG. 10*c*, displacement of the structure 17 from its equilibrium resting position in the direction 16 will cause the bristle structures 11 and 13 to be displace as shown and leave the bristle structure 15 in substantially the same position relative to the support structure 12. Bristle structures such as 11 13 and 15 can be configured to protrude for the structure 17 at any angle relative to the surfaces of the base portion 18 and the wall portion 12, but preferably protrude from the wall portion at an angle 9 between 90 and 10 degrees relative to the wall portion 12.

Figure 11A:
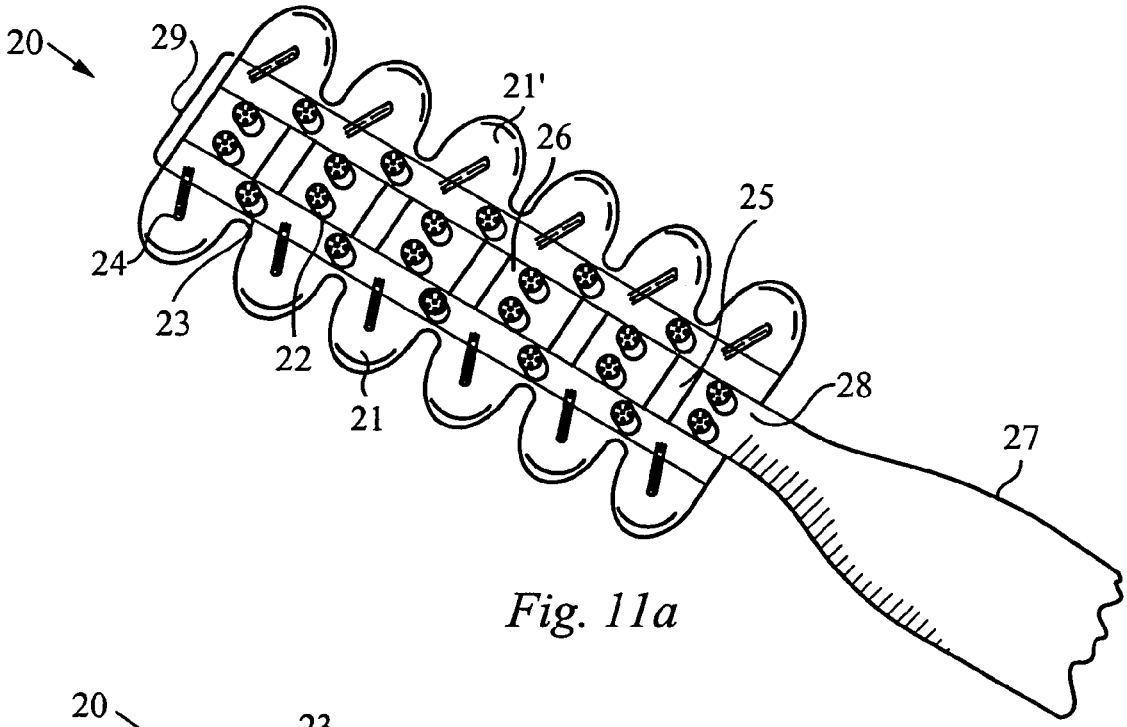
FIG. 11*a* illustrates a perspective top view of a dentition-cleaning device with a contact element according to the preferred embodiment of the invention.

FIG. 11*a* shows a top view of a contact device in accordance with the preferred embodiment of the invention. The device 20 is preferably configured for cleaning dentition. The device 20 has a handle portion 27 for griping and manipulating the device 20 during a cleaning operation. The device 20 has at least one primary structure 29 that preferably forms two sides 21 and 21' giving the device 20 a cleaning cavity or channel. Preferably, the primary structure 29 has a plurality of nodular protrusions 21 that contact surfaces of teeth and gums or dentures during a cleaning operation. The device 20 also preferably has a plurality of bristle structures 23 and 24 that protrude from inner surfaces of the primary structure 29. The primary structure 29 is attached to the handle portion 27 through a support structure 28. The support structure 28 is preferably a channel support structure that is formed of rigid or flexible materials. Alternatively, the channel 28 comprises interspersed flexible segments 25 and rigid segments 26, which allow the channel structure 28 to bend and deform as required during use. Protruding from the channel structure 28 are bristle sections 22 and 23 that have any number of bristles with any number bristle arrangements or configurations. The bristle sections 22 and 23 are comprised of needle-like bristles having any resiliency, texture, geometry or hardness required to facilitate the cleaning of teeth and dentures. The bristles are preferably formed by fiber drawing procedures known in the art. The bristles are formed from nylon, polyester, polyamide or any other suitable plastic resin.

Figure 11B:
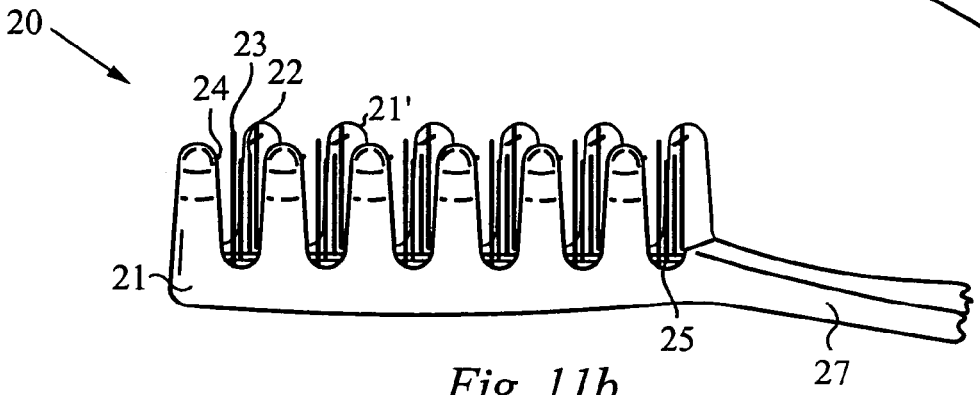
FIG. 11*b* illustrates a perspective side view of the dentition cleaning device shown in the FIG. 11*a*.

FIG. 11*b* shows a perspective side view of the dentition cleaning device 20 shown in FIG. 11*a*. The nodular protrusions on sides 21 and 21' preferable protrude farther than the bristle structures 22 and 23 such that the primary structure 19 cups teeth and dentition within the channel of bristles.

Figure 12:
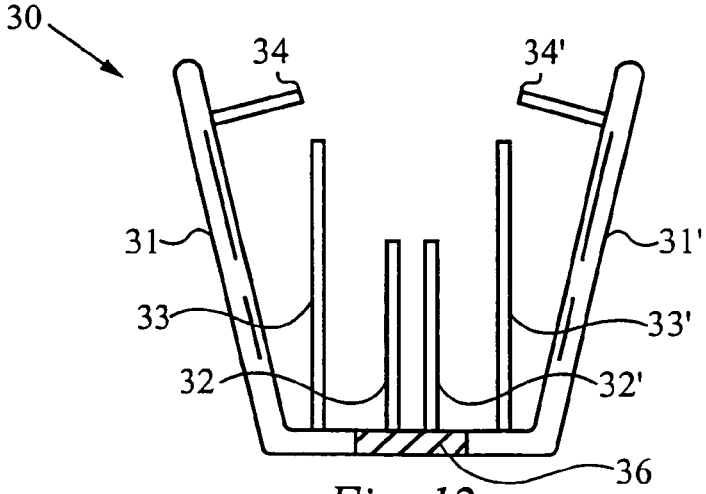
FIG. 12 illustrates a cross-sectional view of a channel contact element with primary and secondary structures in accordance with the instant invention.

FIG. 12 illustrates a cross-sectional view 30 of a contact device in accordance with the instant invention. The L-shaped primary structures 31 and 31' are attached to a support structure 36. The support structure 36 is formed of rigid or flexible materials. The support structure 36 preferably has interspersed flexible segments and rigid segments, as described above and shown in FIG. 11*a*, which allow the support structure 36 to bend and deform as required during use. Protruding from the support structure 36 are bristle structures 32 and 32'. Protruding from inner surfaces of the structures 31 and 31' are bristles structures 33/33' and 34/34', respectively. The flexible backbone structure 36 described is also useful in numerous other devices that are configured to contact and/or clean protruding and/or elongated structures with complex geometries, such as teeth and dentures. In accordance with an embodiment of the invention, the L-shaped primary structures 31 and 31' extended to form a form a continuous channel or a channel section.

The preferred embodiment of the instant invention is particularly useful for guiding and controlling contact positions and angles of the bristle on gums and teeth. The device 20 is also particularly useful for cleaning teeth and gums of persons wearing orthodontia. The device 20 allows bristles to be positioned at angles relative orthodontia that are difficult or impossible to obtain with a conventional toothbrush.

It will be clear to one skilled in the art that the above embodiment may be altered in many ways without departing from the scope of the invention. Any number of structural geometries, combinations of geometries, materials and combinations of material may be used to configure a device with a multi-structural contact element in accordance with the instant invention. Devices of the instant invention can be configured any number or multi-structural contact elements and configured with handles having any number of shape, sizes and extension angles relative to the multi-structural contact elements. Accordingly, the scope of the invention should be determined by the following claims and their legal equivalents.

What is claimed is:

1. A device comprising at least one resilient contact element comprising:

a) a squeegee structure with protruding squeegee walls to form a top wiping edge wherein the top wiping edge of at least one squeegee wall is contoured to form teeth separated by depressions such that a widest part of each tooth is longer along the length of the top wiping edge than transverse to the top wiping edge and b) bristles coupled to the squeegee such that the bristles are anchored in the squeegee wall and protrude from the depressions in the top wiping edge of the squeegee structure; and wherein there are a plurality of distinct clusters of bristles or a plurality of unclustered individual bristles in each depression.

2. The device of claim 1, wherein the squeegee structure comprises a material selected from the group consisting of plastic, silicone, polyurethane, latex, rubber and elastomer.

3. The device of claim 1, wherein the device is a dentition cleaning device.

4. A device comprising:

a) a support structure;

b) a squeegee structure with protruding walls that form a top wiping edge; wherein the top wiping edge of at least one squeegee wall is contoured to form teeth separated by depressions such that a widest part of each tooth is parallel to a length of the support structure; and c) bristles coupled to the squeegee structure such that the bristles are anchored in the squeegee wall and protrude from the depressions in the top wiping edge of the squeegee structure; and wherein there are a plurality of distinct clusters of bristles or a plurality of unclustered individual bristles in each depression.

5. The device of claim 4, wherein the squeegee structure comprises a material selected from the group consisting of plastic, silicone, polyurethane, latex, rubber and elastomer.

6. The device of claim 5, wherein the squeegee structure has a hardness in a range of 10 to 90 Shore A and protrudes from the support structure a distance in the range of 0.2 to 6.0 mm.

* * * * *